US008861764B2

(12) United States Patent
Tanaka et al.

(10) Patent No.: US 8,861,764 B2
(45) **Date of Patent: *Oct. 14, 2014**

(54) MICROPHONE UNIT AND SOUND INPUT DEVICE INCORPORATING SAME

(75) Inventors: Fuminori Tanaka, Osaka (JP); Takeshi Inoda, Osaka (JP); Ryusuke Horibe, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/700,943

(22) PCT Filed: May 27, 2011

(86) PCT No.: PCT/JP2011/062182

§ 371 (c)(1),
(2), (4) Date: Nov. 29, 2012

(87) PCT Pub. No.: WO2011/152299

PCT Pub. Date: Dec. 8, 2011

(65) Prior Publication Data

US 2013/0070951 A1 Mar. 21, 2013

(30) Foreign Application Priority Data

Jun. 1, 2010 (JP) ..... 2010-125531

(51) Int. Cl.
*H04R 1/40* (2006.01)

(52) U.S. Cl.
USPC ..... 381/357; 381/356; 381/355; 381/361

(58) Field of Classification Search
USPC ..... 381/313, 335, 351, 355–357, 360, 361, 381/345, 170, 358; 181/145
See application file for complete search history.

(56) References Cited

U.S. PATENT DOCUMENTS 2,552,878 A 5/1951 Wiggins
6,075,869 A 6/2000 Killion et al.

(Continued)

FOREIGN PATENT DOCUMENTS

JP 2002537743 A 11/2002
JP 2004527177 9/2004

(Continued)

OTHER PUBLICATIONS

Poppy Records, "Tutorial on Microphones", <https://web.archive.org/web/20080725141353/http://www.poppyrecords.co.uk/other/mics.htm>, retrieved Jul. 25, 2008 via Internet Archive.*

(Continued)

*Primary Examiner* — Curtis Kuntz
*Assistant Examiner* — Joshua A Kaufman
(74) *Attorney, Agent, or Firm* — Amster, Rothstein & Ebenstein, LLP

(57) ABSTRACT

An enclosure (10) of a microphone unit (1) includes a mounting portion (11) which has a mounting surface (11*a*) where a first vibration portion (13) and a second vibration portion (15) are mounted and in which, in the back surface (11*b*) of the mounting surface (11*a*), a first sound hole (23) and a second sound hole (25) are provided; in the enclosure (10), a first sound path (41) is provided that transmits sound waves input through the first sound hole (23) to one surface of a first diaphragm (134) and that also transmits the sound waves to one surface of a second diaphragm (154) and a second sound path (42) is provided that transmits sound waves input through the second sound hole to the other surface of the second diaphragm (154).

7 Claims, 16 Drawing Sheets

(56) References Cited

U.S. PATENT DOCUMENTS

| | | | | |
|---|---|---|---|---|
| 6,151,399 | A | 11/2000 | Killion et al. | |
| 2003/0063762 | A1 | 4/2003 | Tajima et al. | |
| 2004/0081327 | A1 | 4/2004 | Jensen | |
| 2005/0084128 | A1 | 4/2005 | Niederdraenk | |
| 2007/0253570 | A1 | 11/2007 | Fukumoto et al. | |
| 2009/0161886 | A1 | 6/2009 | Tanaka et al. | |
| 2009/0175477 | A1 | 7/2009 | Suzuki et al. | |
| 2011/0158449 | A1 | 6/2011 | Tanaka et al. | |
| 2011/0158450 | A1 | 6/2011 | Tanaka et al. | |
| 2012/0257777 | A1* | 10/2012 | Tanaka et al. | 381/355 |

FOREIGN PATENT DOCUMENTS

| | | | |
|---|---|---|---|
| JP | 2005295278 | A | 10/2005 |
| JP | 2009071813 | | 4/2009 |
| JP | 2009100425 | | 5/2009 |
| JP | 2009135777 | | 6/2009 |
| JP | 2009188943 | | 8/2009 |
| WO | 2009099091 | A1 | 8/2009 |

OTHER PUBLICATIONS

International Search Report mailed Aug. 16, 2011 for PCT Application No. PCT/JP2011/062182, filed May 27, 2011.

Supplementary European Search Report, dated Jul. 8, 2013.

European Search Opinion, dated Jul. 8, 2013.

Japanese Patent Office, Apr. 1, 2014 Office Action in Japanese Application No. 2010-125531.

Office Action prepared by the Chinese Patent Office in Chinese Application No. 201180027374.7, dated Jul. 29, 2014.

* cited by examiner

MICROPHONE UNIT AND SOUND INPUT DEVICE INCORPORATING SAME

CROSS-REFERENCE TO RELATED APPLICATIONS

This application is a U.S. national stage entry under 35 U.S.C. §371 of PCT International Application No. PCT/JP2011/062182, filed on May 27, 2011, and claims priority to Japanese Application No. JP 2010-125531, filed on Jun. 1, 2010, the contents of which are incorporated herein by reference in their entirety.

TECHNICAL FIELD

The present invention relates to a microphone unit that has the function of converting an input sound into an electrical signal and outputting it. The present invention also relates to a sound input device incorporating such a microphone unit.

BACKGROUND ART

Conventionally, a microphone unit that has the function of converting an input sound into an electrical signal and outputting it is applied to various types of sound input devices (for example, sound communication devices such as a mobile telephone and a transceiver, information processing systems, such as a sound authentication system, that utilize a technology for analyzing an input sound and a recording device). Such a microphone unit, for example, may be required to suppress background noise and receive only near-sound or may be required to receive not only near-sound but also far-sound.

As an example of a sound input device incorporating a microphone unit, a mobile telephone will be described below. When a mobile telephone is used to start a call, a user generally holds the mobile telephone, and brings his mouth close to a microphone portion and uses it. Hence, the microphone incorporated in the mobile telephone is generally required to have the function of suppressing background noise and receiving only near-sound (function as a close-talking microphone). As the microphone described above, for example, a differential microphone described in patent document 1 is suitable.

However, among mobile telephones today, there is a mobile telephone that has the hands-free function of making a call without holding of the telephone when, for example, driving a car, and a mobile telephone that has the function of video recording. When the mobile telephone utilizing the hands-free function is used, since the mouth of the user is present in a position away from the mobile telephone (for example, in a position 50 cm away), a microphone is required to have the function of receiving not only near-sound but also far-sound. In video recording, since it is necessary to record the atmosphere of the place where the recording is performed, the microphone is required to have the function of receiving not only near-sound but also far-sound.

In other words, in recent years, the mobile telephone has become multifunctional, and thus the microphone incorporated in the mobile telephone is required to have both the function of suppressing background noise and receiving only near-sound and the function of receiving not only near-sound but also far-sound. One way to meet such a requirement is to separately incorporate, in a mobile telephone, a microphone unit having a function as a close-talking microphone and an omnidirectional microphone unit that can also receive far-sound.

Another way is to apply a microphone unit disclosed in, for example, patent document 2 to a mobile telephone. In the microphone unit disclosed in patent document 2, one of the two opening portions for inputting sound can be switched by an opening/shutting system between an open state and a closed state. When the two opening portions are open, the microphone unit disclosed in patent document 2 functions as a bidirectional differential microphone whereas, when one of the two opening portions is closed, it functions as an omnidirectional microphone.

When the microphone unit functions as a bidirectional differential microphone, since it is possible to suppress background noise and receive only near-sound, it is suitable for a case where the user uses the mobile telephone while holding it. On the other hand, when the microphone unit functions as an omnidirectional microphone, since it is also possible to receive far-sound, it is suitable for a case where the hands-free function or the video recording function is used.

RELATED ART DOCUMENT

Patent Document

Patent document 1: JP-A-2009-188943
Patent document 2: JP-A-2009-135777

DISCLOSURE OF THE INVENTION

Problems to be Solved by the Invention

However, when, as described above, the microphone unit having a function as a close-talking microphone and the omnidirectional microphone unit are separately incorporated, it is necessary to increase the area of a mounting substrate on which the microphone units are mounted in the mobile telephone. Since, in recent years, the size of the mobile telephone has been strongly required to be reduced, it is undesirable to increase, as described above, the area of the mounting substrate on which the microphone units are mounted.

In patent document 2, a mechanical mechanism is used to switch its function between the function as a bidirectional differential microphone and the function as an omnidirectional microphone unit. Since the mechanical mechanism is vulnerable to an impact produced when dropped and is also easily made to wear out, there is a fear in terms of durability.

In view of the foregoing points, an object of the present invention is to provide a small-sized microphone unit with which a sound input device is easily made multifunctional. Another object of the present invention is to provide a high-quality sound input device that incorporates such a microphone unit.

Means for Solving the Problem

To achieve the above object, according to the present invention, there is provided a microphone unit including: a first vibration portion that converts a sound signal into an electrical signal based on vibration of a first diaphragm; a second vibration portion that converts a sound signal into an electrical signal based on vibration of a second diaphragm; and an enclosure that holds the first vibration portion and the second vibration portion therewithin and that includes a first sound hole and a second sound hole which face outward, in which the enclosure includes a mounting portion having a mounting surface on which the first vibration portion and the second vibration portion are mounted, the first sound hole and the second sound hole are provided in a back surface of the mounting surface of the mounting portion, in the enclosure, a first sound path is provided that transmits sound waves input through the first sound hole to one surface of the first diaphragm and that also transmits the sound waves to one surface of the second diaphragm and a second sound path is provided that transmits sound waves input through the second sound hole to the other surface of the second diaphragm and the other surface of the first diaphragm faces an airtight space formed within the enclosure.

With the microphone unit configured as described above, it is possible to obtain, by utilizing the first vibration portion, a function as an omnidirectional microphone that can receive not only near-sound but also far-sound and to obtain, by utilizing the second vibration portion, a function as a bidirectional differential microphone having the excellent performance of far noise suppression. Hence, the functionality of the sound input device (for example, a mobile telephone) to which the microphone unit is applied is easily achieved. As a specific example, the following method is possible: for example, in the application of talking over a mobile telephone, the function as the bidirectional differential microphone is utilized to reduce background noise whereas, in the hands-free application or the video recording application, the function as the omnidirectional microphone is utilized. Since the microphone unit configured as described above has the two functions, it is not necessary to separately mount the two microphone units. Hence, it is possible to easily reduce the increase in the size of the sound input device.

Preferably, in the microphone unit configured as described above, the enclosure further includes a lid portion that covers the mounting portion so as to form, together with the mounting portion, a first holding space holding the first vibration portion and a second holding space holding the second vibration portion, in the mounting surface, a first opening portion that is covered over by the first vibration portion and a second opening portion that is covered over by the second vibration portion are provided, the first sound path is formed with the first sound hole, the first opening portion, the second opening portion and a hollow space that is formed within the mounting portion and that makes the first sound hole communicate with the first opening portion and the second opening portion and the second sound path is formed with the second sound hole that is a through hole penetrating the mounting portion and the second holding space.

In this configuration, the hollow space is formed within the mounting portion to obtain the sound path, and thus it is possible to easily reduce the thickness of the microphone unit having the two functions described above. In this configuration, the first holding space forms the airtight space (back room) facing the other surface of the first diaphragm. Since the airtight space can be formed utilizing, for example, a concave space provided in the lid portion, it is easy to acquire a large volume thereof. When the volume of the back room is increased, the vibration film of the vibration portion easily varies, with the result that it is possible to enhance the sensitivity of the vibration portion. Hence, in this configuration, the sensitivity of the first vibration portion utilized when the function as the omnidirectional microphone is obtained is enhanced, and thus it is possible to realize a microphone unit having a high SNR (signal to noise ratio).

Preferably, in the microphone unit configured as described above, the enclosure further includes a lid portion that covers the mounting portion so as to form, together with the mounting portion, a holding space holding the first vibration portion and the second vibration portion, in the mounting surface, an opening portion that is covered over by the second vibration portion is provided, the first sound path is formed with the first sound hole that is a through hole penetrating the mounting portion and the holding space and the second sound path is formed with the second sound hole, the opening portion and a hollow space that is formed within the mounting portion and that makes the second sound hole communicate with the opening portion.

Since, in this configuration, the hollow space is also formed within the mounting portion to obtain the sound path, it is possible to easily reduce the thickness of the microphone unit having the two functions described above.

Preferably, the microphone unit configured as described above includes an electrical circuit portion that is mounted on the mounting portion and that processes electrical signals obtained in the first vibration portion and the second vibration portion. In this case, the electrical circuit portion is preferably formed with a first electrical circuit portion that processes the electrical signal obtained in the first vibration portion and a second electrical circuit portion that processes the electrical signal obtained in the second vibration portion. The electrical signals obtained in the first vibration portion and the second vibration portion may be processed by one electrical circuit portion. Furthermore, the electrical circuit portion may be monolithically formed on the first vibration portion or the second vibration portion. Preferably, when the electrical circuit portion is mounted on the mounting portion, on the mounting surface, an electrode for electrical connection to the electrical circuit portion is formed, and furthermore, on a back surface of the mounting portion, a back surface electrode pad electrically connected to the electrode on the mounting surface is formed. In this way, it is easy to mount the microphone unit in the sound input device.

Preferably, in the microphone unit configured as described above, on the back surface of the mounting surface of the mounting portion, a sealing portion is formed so as to produce airtightness when the sealing portion is mounted on a mounting substrate to surround perimeters of the first sound hole and the second sound hole.

In this configuration, when the microphone unit is mounted on the mounting substrate of the sound input device, it is conveniently unnecessary to additionally prepare a gasket for preventing acoustic leakage.

To achieve the above object, according to the present invention, there is provided a sound input device that includes the microphone unit configured as described above.

In this configuration, since the microphone unit has both the function as an omnidirectional microphone that can also receive far-sound and the function as a bidirectional differential microphone having the excellent performance of far noise suppression, it is possible to provide a high-quality sound input device that selectively uses the microphone function according to the mode used. It is also possible to reduce the size of such a high-quality sound input device.

Advantages of the Invention

According to the present invention, it is possible to provide a small-sized microphone unit in which a sound input device is easily made multifunctional. Moreover, according to the present invention, it is possible to provide a high-quality sound input device that incorporates such a microphone unit.

DESCRIPTION OF EMBODIMENTS

Embodiments of a microphone unit and a sound input device according to the present invention will be described in detail below with reference to accompanying drawings.

(Microphone Unit)

Embodiments of the microphone unit according to the present invention will first be described.

1. Microphone Unit of a First Embodiment

Figure 1A:
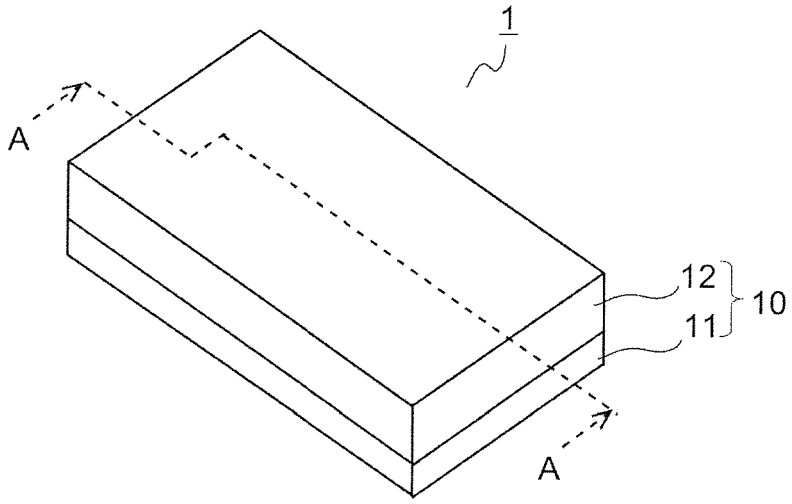
[FIG.1A] A schematic perspective view showing the external configuration of a microphone unit according to a first embodiment, as seen from a diagonally upward direction.
Figure 1B:
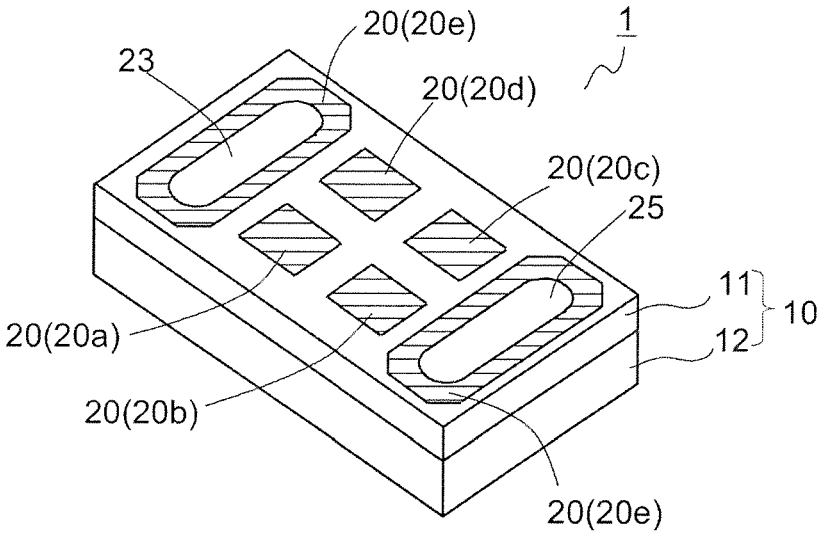
[FIG. 1B] A schematic perspective view showing the external configuration of the microphone unit according to the first embodiment, as seen from a diagonally downward direction.

FIGS. 1A and 1B are schematic perspective views showing the external configuration of a microphone unit according to a first embodiment; FIG. 1A is a view as seen from a diagonally upward direction, and FIG. 1B is a view as seen from a diagonally downward direction. As shown in FIGS. 1A and 1B, the microphone unit 1 of the first embodiment includes an enclosure 10 that is formed with a mounting portion 11 and a lid portion 12 which covers the mounting portion 11 and that is formed substantially in the shape of a rectangular parallelepiped.

Figure 2:
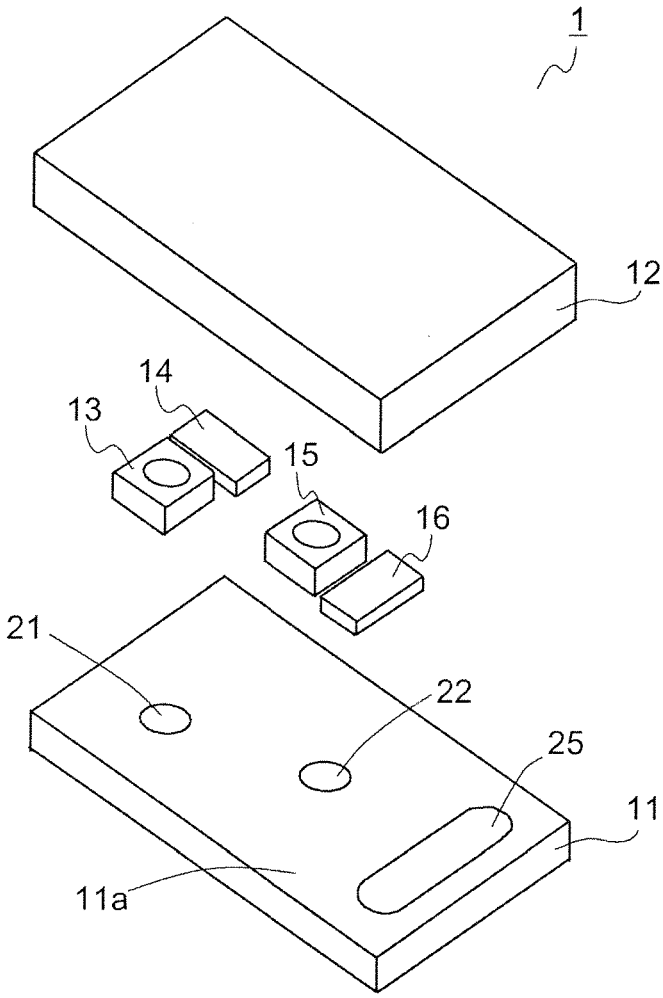
[FIG. 2] An exploded perspective view showing the configuration of the microphone unit according to the first embodiment.
Figure 3:
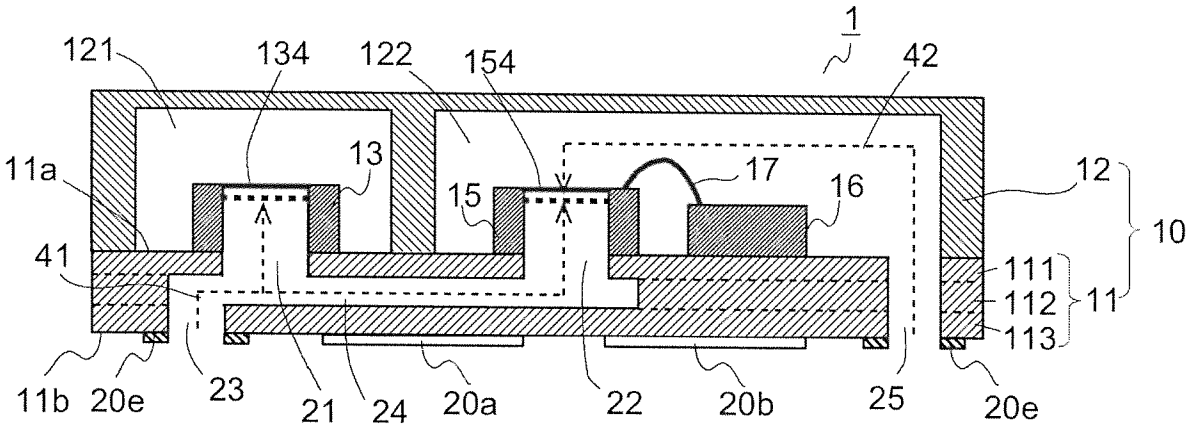
[FIG. 3] A schematic cross-sectional view taken along position A-A, in FIG. 1, of the microphone unit according to the first embodiment.

FIG. 2 is an exploded perspective view showing the configuration of the microphone unit according to the first embodiment. FIG. 3 is a schematic cross-sectional view taken along A-A position, in FIG. 1A, of the microphone unit according to the first embodiment. As shown in FIGS. 2 and 3, within the enclosure 10 formed with the mounting portion 11 and the lid portion 12, a first MEMS (micro electro mechanical system) chip 13, a first ASIC (application specific integrated circuit) 14, a second MEMS chip 15 and a second ASIC 16 are held. The individual portions will be described in detail below.

Figure 4A:
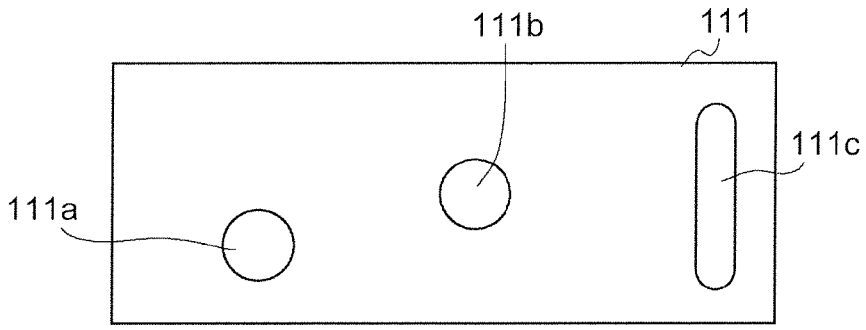
[FIG. 4A] A schematic plan view for illustrating the configuration of a mounting portion incorporated in the microphone unit according to the first embodiment, showing an upper surface view of a first flat plate of the mounting portion.
Figure 4B:
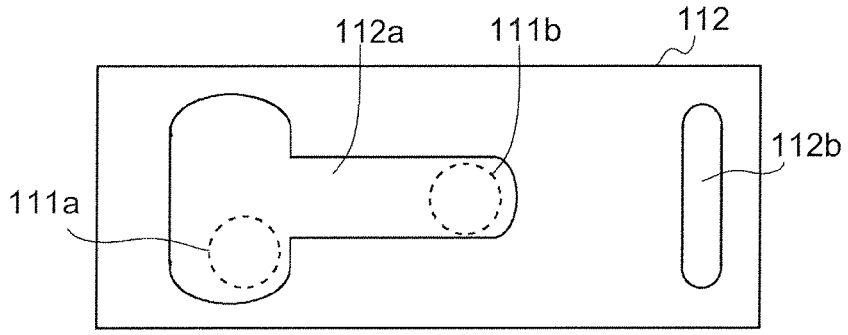
[FIG. 4B] A schematic plan view for illustrating the configuration of the mounting portion incorporated in the microphone unit according to the first embodiment, showing an upper surface view of a second flat plate of the mounting portion.
Figure 4C:
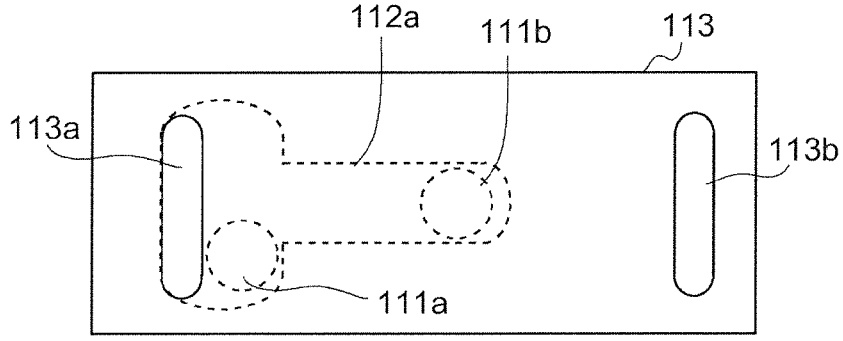
[FIG. 4C] A schematic plan view for illustrating the configuration of the mounting portion incorporated in the microphone unit according to the first embodiment, showing an upper surface view of a third flat plate of the mounting portion.

FIGS. 4A, 4B and 4C are schematic plan views for illustrating the configuration of the mounting portion incorporated in the microphone unit of the first embodiment; FIG. 4A is an upper surface view of a first flat plate of the mounting portion, FIG. 4B is an upper surface view of a second flat plate of the mounting portion and FIG. 4C is an upper surface view of a third flat plate of the mounting portion. In FIGS. 4B and 4C, in order for the relationship between the flat plates forming the mounting portion 11 to be easily understood, through holes that are provided in a flat plate arranged higher than the flat plate shown in each of the figures are represented by broken lines.

As shown in FIGS. 4A, 4B and 4C, each of the three flat plates 111, 112 and 113 forming the mounting portion 11 is formed substantially in the shape of a rectangle as seen in a plan view; the sizes of them as seen in a plan view are substantially equal to each other. As shown in FIG. 3, the third flat plate 113, the second flat plate 112 and the first flat plate 111 are stacked in this order from bottom to top, and the flat plates are bonded with, for example, an adhesive, an adhesive sheet or the like, with the result that the mounting portion 11 of the embodiment can be obtained. The material of the flat plates 111 to 113 forming the mounting portion 11 is not particularly limited; a known material that is used as a substrate material is preferably used, and, for example, a FR-4, a ceramic, a polyimide film or the like is used.

As shown in FIG. 4A, in the first flat plate 111, a first through hole 111*a* that is formed substantially in the shape of a circle as seen in a plan view is formed close to one end (close to the left of FIG. 4A) in its longitudinal direction and close to one end (close to the lower side of FIG. 4A) in its widthwise direction. Moreover, in the first flat plate 111, in a position slightly displaced from an approximate center portion thereof to the other end side (the right side of the FIG. 4A) in the longitudinal direction, a second through hole 111*b* that is formed substantially in the shape of a circle as seen in a plan view is formed. Furthermore, in the first flat plate 111, a third through hole 111*c* that is formed substantially in the shape of a rectangle (stadium shape) as seen in a plan view is formed close to the other end (close to the right of the FIG. 4A) in the longitudinal direction such that the widthwise direction (the vertical direction in FIG. 4A) of the first flat plate 111 is the longitudinal direction thereof.

As shown in FIG. 4B, in the second flat plate 112, a fourth through hole 112*a* that is formed substantially in the shape of a letter T (to be precise, the letter T faces sideway) as seen in a plan view is formed from an approximate center portion close to one end (close to the left of FIG. 4B) in the longitudinal direction. The fourth through hole 112*a* is so positioned as to overlap the first through hole 111*a* and the second through hole 111*b* (represented by broken lines) formed in the first flat plate 111. Moreover, in the second flat plate 112, a fifth through hole 112*b* that is formed substantially in the shape of a rectangle (stadium shape) as seen in a plan view is formed close to the other end (close to the right of FIG. 4B) in the longitudinal direction such that the widthwise direction (vertical direction in FIG. 4B) of the second flat plate 112 is the longitudinal direction thereof. The fifth through hole 112*b* is formed to have the same shape and size as the third through hole 111*c* of the first flat plate 111; the entire fifth through hole 112*b* is so positioned as to be overlaid with the third through hole 111*c*.

As shown in FIG. 4C, in the third flat plate 113, a sixth through hole 113*a* that is formed substantially in the shape of a rectangle as seen in a plan view is formed close to one end (close to the left of FIG. 4C) in the longitudinal direction such that the widthwise direction (vertical direction in FIG. 4C) of the third flat plate 113 is the longitudinal direction thereof. The entire sixth through hole 113*a* is so positioned as to be overlaid on the fourth through hole 112*a* of the second flat plate 112. Moreover, in the third flat plate 113, a seventh through hole 113*b* that is formed substantially in the shape of a rectangle as seen in a plan view is formed close to the other end (close to the right of FIG. 4C) in the longitudinal direction such that the widthwise direction (vertical direction in FIG. 4C) of the third flat plate 113 is the longitudinal direction thereof. The seventh through hole 113*b* is formed to have the same shape and size as the fifth through hole 112*b* of the second flat plate 112; the entire seventh through hole 113*b* is so positioned as to be overlaid with the fifth through hole 112*b*.

With respect to the three flat plates 111 to 113 formed as described above, the third flat plate 113, the second flat plate 112 and the first flat plate 111 are stacked up, as described above, in this order from bottom to top to form the mounting portion 11, and thus a hollow space described below is formed within the mounting portion 11. Specifically, as shown in FIG. 3, the hollow space 24 is formed within the mounting portion 11 so as to make a first opening portion 21 (an upper surface portion of the first through hole 111*a*) and a second opening portion 22 (an upper surface portion of the second through hole 111*b*) provided in the upper surface 11*a* of the mounting portion 11 communicate with a third opening portion 23 (a lower surface portion of the sixth through hole 113*a*) provided in the lower surface 11*b* of the mounting portion 11. When the three flat plates 111 to 113 are stacked up as described above to form the mounting portion 11, the three through holes 111*c*, 112*b* and 113*b* are made to communicate to form one through hole 25 that penetrates the mounting portion 11 in the direction of the thickness and that is formed substantially in the shape of a rectangle as seen in a plan view (see FIG. 3).

An electrode pad and electrical wiring are formed on the mounting portion 11; they will be described later. Although, in the present embodiment, the mounting portion 11 is obtained by bonding the three flat plates, the present invention is not limited to this configuration. The mounting portion 11 may be formed with one flat plate or may be formed with a plurality of flat plates other than the three flat plates. The mounting portion 11 is not limited to be plate-shaped. When the mounting portion 11 that is not plate-shaped is formed with a plurality of members, a member that is not plate-shaped may be included in the members that form the mounting portion 11. Furthermore, the shapes of the opening portions 21, 22 and 23, the hollow space 24 and the through hole 25 formed in the mounting portion 11 are not limited to the configuration of the present embodiment. They may be changed as necessary.

Figure 5A:
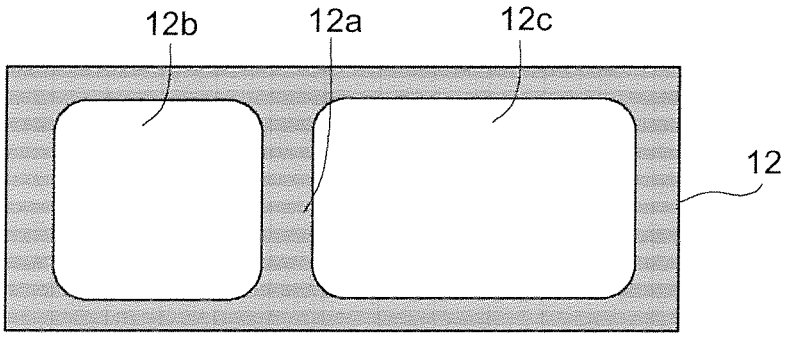
[FIG. 5A] A schematic plan view for illustrating the configuration of a lid portion incorporated in the microphone unit according to the first embodiment, showing a diagram of the lid portion of a first configuration example.
Figure 5B:
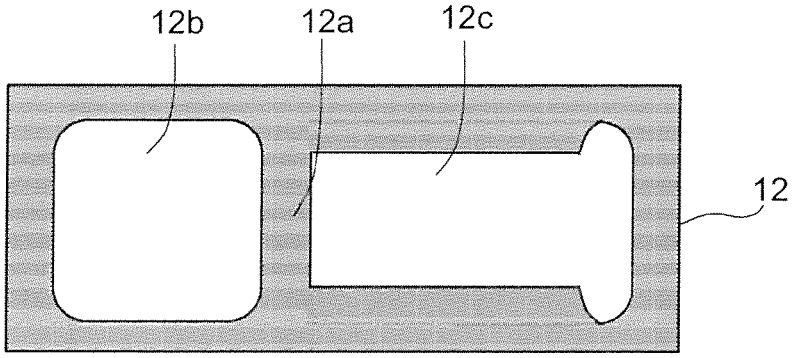
[FIG. 5B] A schematic plan view for illustrating the configuration of the lid portion incorporated in the microphone unit according to the first embodiment, showing a diagram of the lid portion of a second configuration example.

FIGS. 5A and 5B are schematic plan views for illustrating the configuration of the lid portion incorporated in the microphone unit of the first embodiment; FIG. 5A shows a first configuration example of the lid portion, and FIG. 5B shows a second configuration example of the lid portion. FIGS. 5A and 5B are views when the lid portion 12 is seen from below.

The outside shape of the lid portion 12 is formed substantially in the shape of a rectangular parallelepiped (see FIGS. 1A, 1B, 2 and 3). The lengths of the lid portion 12 in its longitudinal direction (the left/right direction of FIG. 5A and FIG. 5B) and in its widthwise direction (the up/down direction of FIG. 5A and FIG. 5B) are adjusted such that, when the lid portion 12 covers the mounting portion 11 to form the enclosure 10, the side surface portions of the enclosure 10 are substantially flush. As the material of the lid portion 12, a resin such as a LCP (liquid crystal polymer) or a PPS (polyphenylene sulfide) can be used. Here, in order for the resin of the lid portion 12 to become conductive, a metal filer such as a stainless steel or carbon may be mixed with and contained in the resin. As the material of the lid portion 12, a substrate material such as a FR-4 or a ceramic may be used.

As shown in FIGS. 5A and 5B, the lid portion 12 includes two concave portions 12*b* and 12*c* that are divided by a division portion 12*a*. Hence, the lid portion 12 covers the mounting portion 11, and thus two spaces 121 and 122 (see FIG. 3) independent of each other are obtained. Since, as will be described later, the two spaces 121 and 122 are used as spaces for holding the MEMS chip and the ASIC, in the following description, the space 121 is referred to as the first holding space 121 and the space 122 is referred to as the second holding space 122.

Each of the concave portions 12*b* and 12*c* provided in the lid portion 12 may be formed substantially in the shape of a rectangle (substantially in the shape of a rectangular parallelepiped) as seen in a plan view, as shown in FIG. 5A. The concave portion 12*c* forming the second holding space 122 that is used as a sound path when the lid portion 12 covers the lid portion 12 (this point will be described later) is preferably formed substantially in the shape of a letter T as seen in a plan view.

By formation as shown in FIG. 5B, in the second holding space 122, the area of the opening of a portion (here, a portion connected to the through hole 25) serving as an entrance of sound can be increased, and the volume of the entire second holding space 122 can also be reduced. Thus, it is possible to set an acoustic resonant frequency of the second holding space 122 to the high frequency side. In this case, a microphone characteristic using the second MEMS chip 15 (see FIG. 3) held in the second holding space 122 can be made satisfactory (it is possible to appropriately suppress noise on the high frequency side).

Here, a supplementary description will be give of the resonant frequency. In general, when a model where the second holding space 122 and the entrance of sound connected thereto are present is considered, the model has an acoustic resonant frequency specific to the model. This resonant frequency is called the Helmholtz resonance. In this model, from a qualitative viewpoint, as the area S of the entrance of sound is increased and/or the volume V of the second holding space 122 is decreased, the resonant frequency is increased. Conversely, as the area S of the entrance of sound is decreased and/or the volume V of the second holding space 122 is increased, the resonant frequency is decreased. As the resonant frequency is decreased to approach a sound frequency band (to 10 kHz), the frequency characteristic and the sensitivity characteristic of the microphone are adversely affected. Hence, the resonant frequency is preferably set as high as possible.

Although, in the above description, the concave portion 12*c* forming the second holding space 122 is formed substantially in the shape of a letter T as seen in a plan view, the shape of the concave portion 12*c* is not limited to this shape. It is preferable to make a design according to the arrangement of the MEMS chip and the ASIC such that the volume V of the second holding space 122 is minimized. For the same reason, in the mounting portion 11, the fourth through hole 112*a* that is formed substantially in the shape of a letter T as seen in a plan view is formed in the second flat plate 112 among the three flat plates. The area of the opening of the portion (the portion connected to the sixth through hole 113*a*) serving as the entrance of sound is increased, and the volume of the hollow space 24 is decreased, with the result that the resonant frequency is set high.

Figure 6:
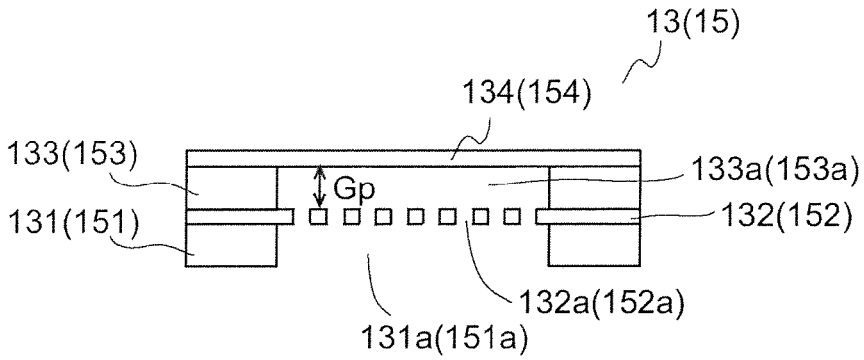
[FIG. 6] A schematic cross-sectional view showing the configuration of MEMS chips incorporated in the microphone unit according to the first embodiment.

As shown in FIGS. 2 and 3, in the microphone unit 1, the two MEMS chips, the first MEMS chip 13 and the second MEMS chip 15, are mounted on the mounting portion 11. The two MEMS chips 13 and 15 each are formed with a silicon chip, and their configurations are the same. Hence, the configuration of the MEMS chip incorporated in the microphone unit 1 will be described with reference to FIG. 6 using the first MEMS chip 13 as an example. FIG. 6 is a schematic cross-sectional view showing the configuration of the MEMS chip incorporated in the microphone unit of the first embodiment. In FIG. 6, parenthesized symbols are symbols that correspond to the second MEMS chip 15. The MEMS chip is an embodiment of a vibration portion according to the present invention.

As shown in FIG. 6, the first MEMS chip 13 includes an insulating first base substrate 131, a first fixed electrode 132, a first insulating layer 133 and a first diaphragm 134.

In the first base substrate 131, a through hole 131*a* that is formed substantially in the shape of a circle as seen in a plan view is formed in the middle portion thereof. The first fixed electrode 132 is arranged on the first base substrate 131; in the first fixed electrode 132, a plurality of through holes 132*a* having a small diameter are formed. The first insulating layer 133 is arranged on the first fixed electrode 132; as in the first base substrate 131, a through hole 133*a* that is formed substantially in the shape of a circle as seen in a plan view is formed in the middle portion thereof. The first diaphragm 134 arranged on the first insulating layer 133 is a thin film that receives a sound pressure to vibrate (vibrate in the up/down direction of FIG. 6) and is conductive to form one end of the electrode. The first fixed electrode 132 and the first diaphragm 134 that are arranged substantially parallel to and opposite each other with a gap Gp formed therebetween due to the presence of the first insulating layer 133 form a capacitor.

Since the through hole 131*a* formed in the first base substrate 131, the through holes 132*a* formed in the first fixed electrode 132 and the through hole 133*a* formed in the first insulating layer 133 are present, sound waves reach the first diaphragm 134 not only from above but also from below.

In the first MEMS chip 13 that is configured as a capacitor microphone as described above, when the first diaphragm 134 vibrates by receiving sound waves, the capacitance between the first diaphragm 134 and the first fixed electrode 132 varies. Consequently, sound waves (sound signals) entering the first MEMS chip 13 can be taken out as electrical signals. Likewise, in the second MEMS chip 15 incorporating a second base substrate 151, a second fixed electrode 152, a second insulating layer 153 and a second diaphragm 154, sound waves (sound signals) entering the second MEMS chip 15 can be taken out as electrical signals. In other words, the first MEMS chip 13 and the second MEMS chip 15 have the function of converting sound signals into electrical signals.

The configurations of the MEMS chips 13 and 15 are not limited to the configurations of the present embodiment; the configurations may be changed as necessary. For example, although, in the present embodiment, the diaphragms 134 and 154 are arranged on the fixed electrodes 132 and 152, they may be configured to form the opposite relationship (in which the fixed electrodes arranged on the diaphragms).

The first ASIC 14 is an integrated circuit that performs amplification processing on the electrical signals taken out based on variations in the capacitance of the first MEMS chip 13 (derived from the vibrations of the first diaphragm 134). The second ASIC 16 is an integrated circuit that performs amplification processing on the electrical signals taken out based on variations in the capacitance of the second MEMS chip 15 (derived from the vibrations of the second diaphragm 154). The ASIC is an embodiment of an electrical circuit portion according to the present invention.

Figure 7:
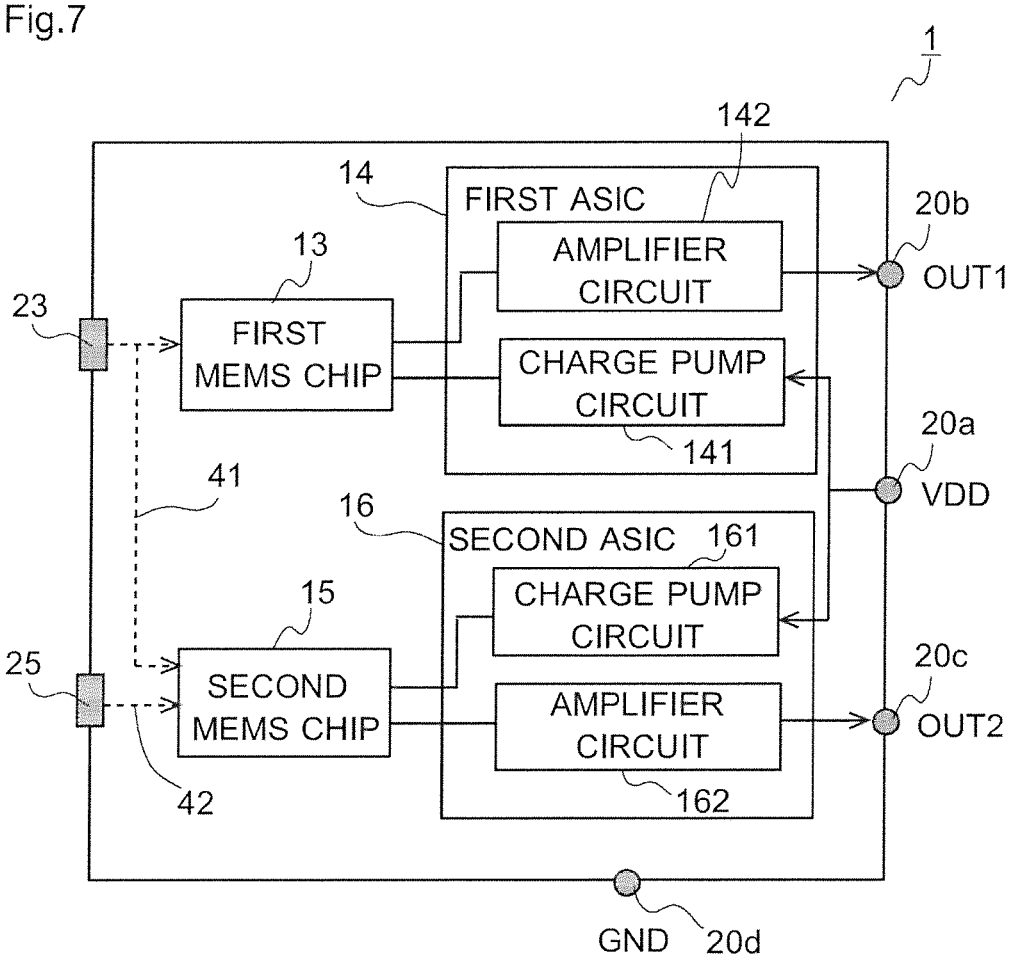
[FIG. 7] A block diagram showing the configuration of the microphone unit according to the first embodiment.

As shown in FIG. 7, the first ASIC 14 includes a charge pump circuit 141 that applies a bias voltage to the first MEMS chip 13. The charge pump circuit 141 steps up (for example, to about 6 to 10 volts) a power supply voltage VDD (for example, about 1.5 to 3 volts), and thereby applies the bias voltage to the first MEMS chip 13. The first ASIC 14 includes an amplifier circuit 142 that detects variations in the capacitance of the first MEMS chip 13. The electrical signal amplified by the amplifier circuit 142 is output from the first ASIC 14 (OUT1). Likewise, the second ASIC 16 includes a charge pump circuit 161 that applies a bias voltage to the second MEMS chip 15 and an amplifier circuit 162 that outputs (OUT2) the electrical signal amplified by detecting variations in the capacitance. FIG. 7 is a block diagram showing the configuration of the microphone unit according to the first embodiment.

Figure 8:
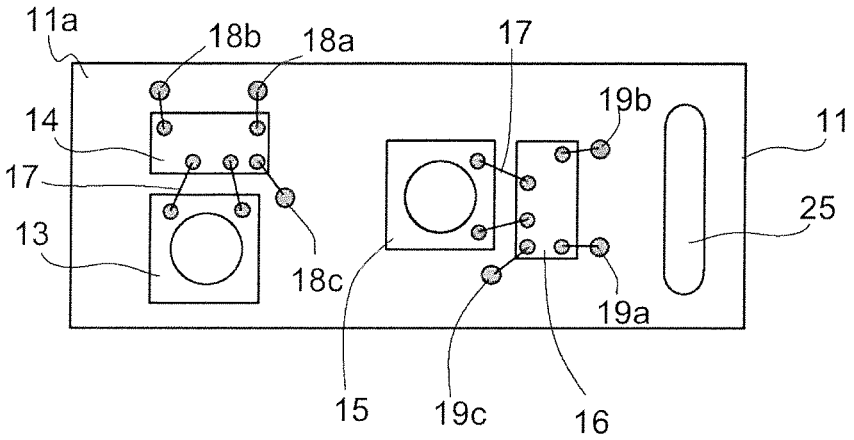
[FIG. 8] A schematic plan view of the mounting portion incorporated in the microphone unit according to the first embodiment, as seen from above, showing a diagram of a state where the MEMS chips and ASICs are mounted.

The positional relationship and the electrical connection relationship of the two MEMS chips 13 and 15 and the two ASICs 14 and 16 in the microphone unit 1 will now be described mainly with reference to FIG. 8. FIG. 8 is a schematic plan view of the mounting portion incorporated in the microphone unit of the first embodiment, as seen from above (from the side of the mounting surface) showing a diagram of a state where the MEMS chips and the ASICs are mounted.

The two MEMS chips 13 and 15 are mounted on the mounting portion 11 such that the diaphragms 134 and 154 are substantially parallel to the mounting surface (upper surface) 11*a* of the mounting portion 11 (see FIG. 3). As shown in FIG. 8, the first MEMS chip 13 and the first ASIC 14 are mounted close to one end in the longitudinal direction of the mounting portion 11 (close to the left of FIG. 8) with the first MEMS chip 13 and the first ASIC 14 aligned in the widthwise direction. The second MEMS chip 15 is mounted in a position slightly displaced from an approximate center portion of the mounting portion 11 to the other end side (the right side of FIG. 8) in the longitudinal direction. With respect to the second MEMS chip 15, the second ASIC 16 is mounted on the mounting portion 11 on the other end side (the right side of FIG. 8) in the longitudinal direction.

The first MEMS chip 13 is mounted on the mounting portion 11 so as to cover the first opening portion 21 (see FIGS. 2 and 3) formed in the mounting surface (upper surface) 11*a* of the mounting portion 11. The second MEMS chip 15 is mounted on the mounting portion 11 so as to cover the second opening portion 22 (see FIGS. 2 and 3) formed in the upper surface 11*a* of the mounting portion 11.

The arrangement of the two MEMS chips 13 and 15 and the two ASICs 14 and 16 is not intended to be limited to the configuration of the present embodiment; it may be changed as necessary. For example, with respect to each group of the MEMS chips and the ASICs, any of the MEMS chips and any of the ASICs may be aligned in the longitudinal direction or may be aligned in the widthwise direction.

The two MEMS chips 13 and 15 and the two ASICs 14 and 16 are mounted on the mounting portion 11 by die bonding and wire bonding. Specifically, the first MEMS chip 13 and the second MEMS chip 15 are joined onto the upper surface 11*a* of the mounting portion 11 with an unillustrated die bond material (for example, an adhesive of epoxy resin or silicone resin) so that no gap is formed between their bottom surfaces and the upper surface 11*a* of the mounting portion 11. The joining described above prevents sound from entering the MEMS chips 13 and 15 through a gap formed between the upper surface 11*a* of the mounting portion 11 and the bottom surfaces of the MEMS chips 13 and 15. As shown in FIG. 8, the first MEMS chip 13 is electrically connected to the first ASIC 14 by wires 17 (preferably, gold wires), and the second MEMS chip 15 is electrically connected to the second ASIC 16 by wires 17 (preferably, gold wires).

In each of the two ASICs 14 and 16, their bottom surfaces opposite the mounting surface (upper surface) 11*a* of the mounting portion 11 are joined onto the upper surface 11*a* of the mounting portion 11 with an unillustrated die bond material. As shown in FIG. 8, the first ASIC 14 is electrically connected, with the wires 17, to a plurality of electrode terminals 18*a*, 18*b* and 18*c* formed on the upper surface 11*a* of the mounting portion 11. The electrode terminal 18*a* is a power supply terminal for the input of the power supply voltage (VDD), the electrode terminal 18*b* is a first output terminal through which the electrical signal subjected to the amplification processing in the amplifier circuit 142 of the first ASIC 14 is output and the electrode terminal 18*c* is a GND terminal for ground connection.

Likewise, the second ASIC 16 is electrically connected, with the wires 17, to a plurality of electrode terminals 19*a*, 19*b* and 19*c* formed on the upper surface 11*a* of the mounting portion 11. The electrode terminal 19*a* is a power supply terminal for the input of the power supply voltage (VDD), the electrode terminal 19*b* is a second output terminal through which the electrical signal subjected to the amplification processing in the amplifier circuit 162 of the second ASIC 16 is output and the electrode terminal 19*c* is a GND terminal for ground connection.

On the back surface (the lower surface of the mounting portion 11) of the upper surface 11*a* of the mounting portion 11, as shown in FIGS. 1B and 3, an external connection electrode pad 20 is formed. The external connection electrode pad 20 includes a power supply electrode pad 20*a*, a first output electrode pad 20*b*, a second output electrode pad 20*c* and a GND electrode pad 20*d* and a sealing electrode pad 20*e*.

The power supply terminals 18*a* and 19*a* provided on the upper surface 11*a* of the mounting portion 11 are electrically connected to the power supply electrode pad 20*a* through unillustrated wiring (including penetration wiring) formed on the mounting portion 11. The output terminal 18*b* provided on the upper surface 11*a* of the mounting portion 11 is electrically connected to the first output electrode pad 20*b* through unillustrated wiring (including penetration wiring) formed on the mounting portion 11. The second output terminal 19*b* provided on the upper surface 11*a* of the mounting portion 11 is electrically connected to the second output electrode pad 20*c* through unillustrated wiring (including penetration wiring) formed on the mounting portion 11. The GND terminals 18*c* and 19*c* provided on the upper surface 11*a* of the mounting portion 11 are electrically connected to the GND electrode pad 20*d* through unillustrated wiring (including penetration wiring) formed on the mounting portion 11. The penetration wiring can be formed by through hole via that is generally used in the manufacturing of substrates.

The sealing electrode pad 20*e* is used to maintain airtightness when the microphone unit 1 is mounted on the mounting substrate of a sound input device such as a mobile telephone; its details will be described later.

Although, in the present embodiment, the two MEMS chips 13 and 15 and the two ASICs 14 and 16 are mounted by wire bonding, the two MEMS chips 13 and 15 and the two ASICs 14 and 16 may naturally be mounted by flip chip. In this case, electrodes are formed on the bottom surfaces of the MEMS chips 13 and 15 and the ASICs 14 and 16, the corresponding electrode pads are arranged on the upper surface of the mounting portion 11 and the wire connection thereof is performed by a wiring pattern formed on the mounting portion 11.

The lid portion 12 is joined (for example, using an adhesive or an adhesive sheet) onto the mounting portion 11 (since, in the present embodiment, it is formed by bonding the substrates, it may be expressed to be a substrate portion) on which the two MEMS chips 13 and 15 and the two ASICs 14 and 16 are mounted such that airtight sealing is achieved, with the result that the microphone unit 1 including, in the enclosure 10, the first MEMS chip 13, the first ASIC 14, the second MEMS chip 15 and the second ASIC 16 is obtained. In the microphone unit 1, as shown in FIG. 3, the first MEMS chip 13 and the first ASIC 14 are held in the first holding space 121, and the second MEMS chip 15 and the second ASIC 16 are held in the second holding space 122.

In the microphone unit 1, as shown in FIG. 3, sound waves input from the outside through the third opening portion 23 pass through the hollow space 24 and the first opening portion 21 to reach the bottom surface of the first diaphragm 134, and also pass through the hollow space 24 and the second opening portion 22 to reach the bottom surface of the second diaphragm 154. Sound waves input from the outside through the through hole 25 pass through the second holding space 122 to reach the upper surface of the second diaphragm 154. Since the third opening portion 23 and the through hole 25 are used to input sound waves into the enclosure 10, in the following description, the third opening portion 23 is expressed as the first sound hole 23 and the through hole 25 is expressed as the second sound hole 25.

Thus, in the microphone unit 1, there are provided: a first sound path 41 that transmits the sound waves input through the first sound hole 23 to one surface (the lower surface) of the first diaphragm 134 and that also transmits them to one surface (the lower surface) of the second diaphragm 154; and a second sound path 42 that that transmits the sound waves input through the second sound hole 25 to the other surface (the upper surface) of the second diaphragm 154. In the microphone unit 1, sound waves are prevented from being input from the outside through the other surface (the upper surface) of the first diaphragm 134, and thus an airtight space (back room) without acoustic leakage is formed.

The spacing (distance between the centers) between the first sound hole 23 and the second sound hole 25 provided in the microphone unit 1 is preferably equal to or more than 3 mm but equal to or less than 10 mm, and is more preferably equal to or more than 4 mm but equal to or less than 6 mm. This configuration is designed to reduce the following problem: if the spacing between the two sound holes 23 and 25 is excessively wide, the phase difference between the sound waves input through the sound holes 23 and 25 and reaching the second diaphragm 154 is increased, and thus the microphone characteristic is decreased (the noise reduction performance is decreased). The above configuration is also designed to reduce the following problem: if the spacing between the two sound holes 23 and 25 is excessively narrow, the difference between sound pressures applied to the upper surface and the lower surface of the second diaphragm 154 is decreased, and thus the amplitude of the second diaphragm 154 is decreased, with the result that the SNR (signal to noise ratio) of an electrical signal output from the second ASIC 16 is degraded.

In order for a high noise suppression effect to be obtained in a wide frequency range, the distance of travel of sound passing through the first sound path 41 (see FIG. 3) from the first sound hole 23 to the second diaphragm 154 is preferably made substantially equal to the distance of travel of sound passing through the second sound path 42 (see FIG. 3) from the second sound hole 25 to the second diaphragm 154.

Although, in the microphone unit 1, the first sound hole 23 and the second sound hole 25 provided in the enclosure 10 are formed in the shape of a long hole, their shape is not limited to this configuration. For example, they each may be formed substantially in the shape of a circle as seen in a plan view. However, as in the configuration described above, the shape of a long hole is preferably formed because, for example, it is possible to prevent the length of the microphone unit 1 in the longitudinal direction (which corresponds to the left/right direction of FIG. 3) from increasing, in order to reduce the package size and to increase the cross-sectional area of the sound hole. The effect obtained by increasing the cross-sectional area of the sound hole has already been described. Since, as the cross-sectional area of the sound hole is increased, the resonant frequency of the space forming the sound path can be increased, it is possible to obtain, as a microphone, the flat performance over a broad band.

The amplification gain of the amplifier circuit 142 that detects variations in the capacitance of the first MEMS chip 13 and the amplification gain of the amplifier circuit 162 that detects variations in the capacitance of the second MEMS chip 15 may be set different from each other. Since the second diaphragm 154 of the second MEMS chip 15 is vibrated by the difference between sound pressures applied to both surfaces (the upper surface and the lower surface), the vibration amplitude of the second diaphragm 154 of the second MEMS chip 15 is lower than that of the first diaphragm 134 of the first MEMS chip 13. Hence, for example, the amplification gain of the amplifier circuit 162 of the second ASIC 16 may be made higher than that of the amplifier circuit 142 of the first ASIC 14. Specifically, when the distance between the centers of the two sound holes 23 and 25 is about 5 mm, the amplification gain of the amplifier circuit 162 of the second ASIC 16 is preferably set higher than that of the amplifier circuit 142 of the first ASIC 14 by about 6-14 dBs In this way, since the amplitudes of signals output from the two amplifier circuits 142 and 162 can be made substantially equal to each other, it is possible to reduce the occurrence of wide variations in output amplitude when a user selects and switches the outputs from both the amplifiers.

The effects of the microphone unit 1 according to the first embodiment will now be described.

When sound is produced outside the microphone unit 1, sound waves input through the first sound hole 23 reach the lower surface of the first diaphragm 134 through the first sound path 41, and the first diaphragm 134 vibrates. Thus, variations in the capacitance of the first MEMS chip 13 are produced. Electrical signals taken out based on variations in the capacitance of the first MEMS chip 13 are subjected to amplification processing by the amplifier circuit 142 of the first ASIC 14, and are finally output from the first output electrode pad 20*b* (see FIGS. 3 and 7 for what has been described above).

Moreover, when sound is produced outside the microphone unit 1, the sound waves input through the first sound hole 23 reach the lower surface of the second diaphragm 154 through the first sound path 41, and sound waves input through the second sound hole 25 reach the upper surface of the second diaphragm 154 through the second sound path 42. Hence, the second diaphragm 154 is vibrated by the difference between a sound pressure applied to the upper surface and a sound pressure applied to the lower surface. Thus, variations in the capacitance of the second MEMS chip 15 are produced. Electrical signals taken out based on variations in the capacitance of the second MEMS chip 15 are subjected to amplification processing by the amplifier circuit 162 of the second ASIC 16, and are finally output from the second output electrode pad 20*c* (see FIGS. 3 and 7 for what has been described above).

As described above, in the microphone unit 1, the signal obtained by using the first MEMS chip 13 and the signal obtained by using the second MEMS chip 15 are separately output to the outside. Incidentally, the microphone unit 1 behaves differently between a case where only the first MEMS chip 13 is utilized and a case where only the second MEMS chip 15 is utilized. This will be described below.

Figure 9:
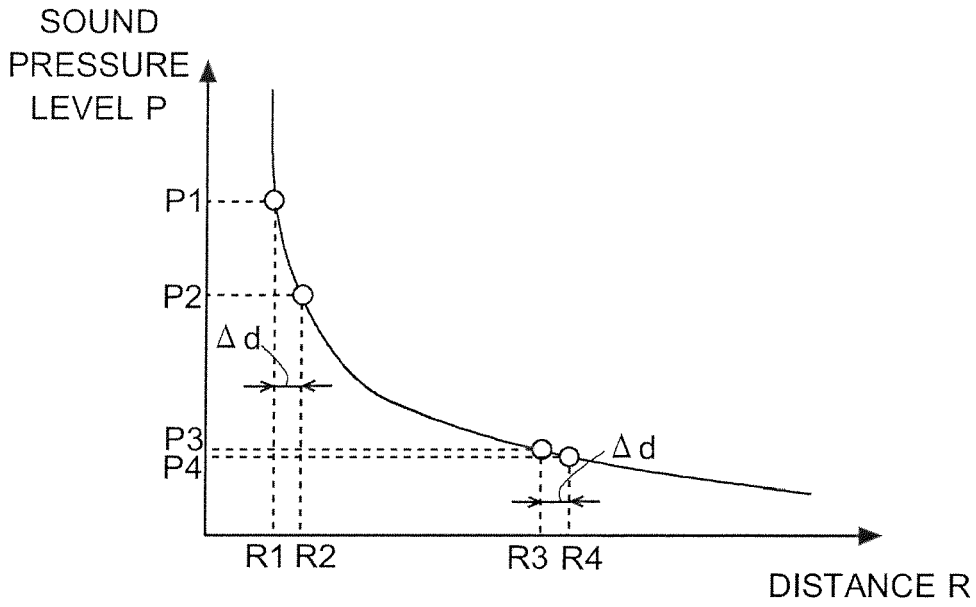
[FIG. 9] A graph showing the relationship between a sound pressure P and a distance R from a sound source.

Before the description, the properties of sound waves will be discussed. FIG. 9 is a graph showing the relationship between a sound pressure P and a distance R from a sound source. As shown in FIG. 9, as the sound wave travels in a medium such as air, it is attenuated, and the sound pressure (the intensity and amplitude of the sound wave) is decreased. The sound pressure is inversely proportional to the distance from the sound source; the relationship between the sound pressure P and the distance R can be represented by formula (I) below, where k is a proportionality constant.

$$P=k/R \quad (1)$$

As is obvious from FIG. 9 and formula (1), the sound pressure is significantly attenuated near the sound source (the left side of the graph), and the sound pressure is gently attenuated as the sound moves away from the sound source (the right side of the graph). Specifically, the sound pressure transmitted between two positions (R1 and R2, R3 and R4) where the difference of the distances from the sound source is Δd is greatly attenuated (P1–P2) between R1 and R2 where the distance from the sound source is short, but is only slightly attenuated (P3–P4) between R3 and R4 where the distance from the sound source is long.

Figure 10A:
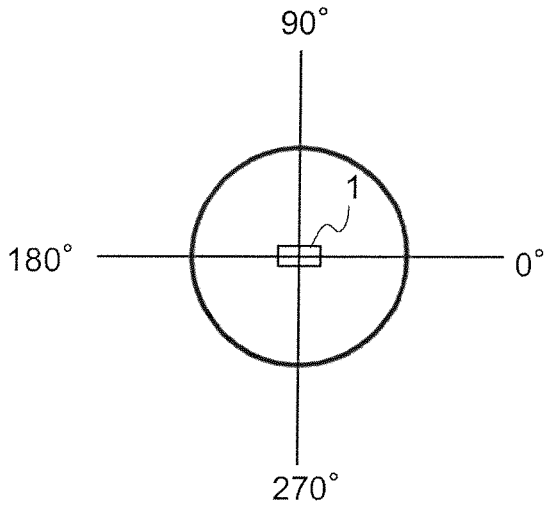
[FIG. 10A] A diagram for illustrating the directivity characteristic of the microphone unit according to the first embodiment, illustrating the directivity characteristic when the side of the first MEMS chip is utilized.
Figure 10B:
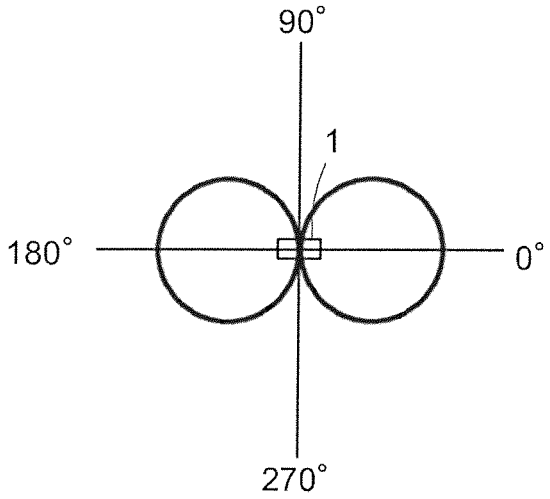
[FIG. 10B] A diagram for illustrating the directivity characteristic of the microphone unit according to the first embodiment, illustrating the directivity characteristic when the side of the second MEMS chip is utilized.

FIGS. 10A and 10B are diagrams for illustrating the directivity characteristics of the microphone unit according to the first embodiment. FIG. 10A is a diagram for illustrating the directivity characteristic when the side of the microphone unit that corresponds to the first MEMS chip 13 is utilized, and FIG. 10B is a diagram for illustrating the directivity characteristic when the side of the microphone unit that corresponds to the second MEMS chip 15 is utilized. The posture of the microphone unit 1 in FIGS. 10A and 10B is expected to be the same as shown in FIG. 3.

When the distance from the sound source to the first diaphragm 134 is constant, the sound pressure applied to the first diaphragm 134 is constant in whichever direction the sound source is present. Specifically, when the side of the microphone unit that corresponds to the first MEMS chip 13 is utilized, as shown in FIG. 10A, the microphone unit 1 has an omnidirectional characteristic in which sound waves input from all directions are uniformly received.

On the other hand, when the side of the microphone unit that corresponds to the second MEMS chip 15 is utilized, the microphone unit 1 does not have an omnidirectional characteristic but has a bidirectional characteristic as shown in FIG. 10B. If the distance from the sound source to the second diaphragm 154 is constant, when the sound source is present in a direction of 0° or 180°, the sound pressure applied to the second diaphragm 154 is the highest. This is because the difference between the distance over which the sound wave travels from the first sound hole 23 to the lower surface of the second diaphragm 154 and the distance over which the sound wave travels from the second sound hole 25 to the upper surface of the second diaphragm 154 is the greatest.

By contrast, when the sound source is present in a direction of 90° or 270°, the sound pressure applied to the second diaphragm 154 is the lowest (0). This is because the difference between the distance over which the sound wave travels from the first sound hole 23 to the lower surface of the second diaphragm 154 and the distance over which the sound wave travels from the second sound hole 25 to the upper surface of the second diaphragm 154 is approximately zero. In other words, when the side of the microphone unit that corresponds to the second MEMS chip 15 is utilized, the microphone unit 1 has a high sensitivity to the sound wave input from a direction of 0° or 180°, and has a low sensitivity (has a bidirectional characteristic) to the sound wave input from a direction of 90° or 270°.

Figure 11:
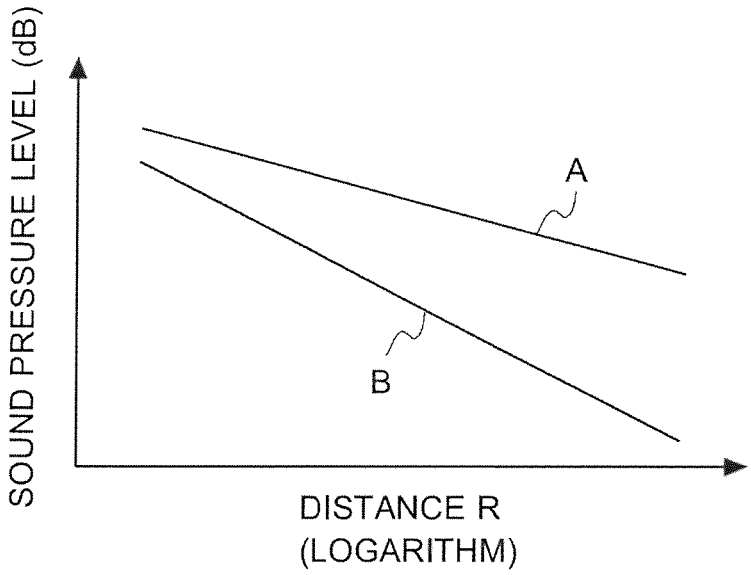
[FIG. 11] A graph for illustrating the microphone characteristic of the microphone unit according to the first embodiment.

FIG. 11 is a graph for illustrating the microphone characteristic of the microphone unit according to the first embodiment; the horizontal axis represents the distance R from the sound source on a logarithmic axis, and the vertical axis represents a sound pressure level (dB) applied to the diaphragm of the microphone unit. In FIG. 11, A represents the microphone characteristic of the microphone unit 1 when the side of the microphone unit that corresponds to the first MEMS chip 13 is utilized, and B represents the microphone characteristic of the microphone unit 1 when the side of the microphone unit that corresponds to the second MEMS chip 15 is utilized.

In the first MEMS chip 13, the first diaphragm 134 is vibrated by a sound pressure applied to one surface (the lower surface) of the first diaphragm 134 whereas, in the second MEMS chip 15, the second diaphragm 154 is vibrated by the difference between sound pressures applied to both surfaces (the upper surface and the lower surfaces). In the distance attenuation characteristic, when the side of the microphone unit that corresponds to the first MEMS chip 13 is utilized, the sound pressure level is attenuated by 1/R whereas, when the side of the microphone unit that corresponds to the second MEMS chip 15 is utilized, the characteristic is obtained by differentiating the characteristic of the first MEMS chip 13 with respect to the distance R, and the sound pressure level is attenuated by $1/R^2$. Hence, as shown in FIG. 11, when the side of the microphone unit that corresponds to the second MEMS chip 15 is utilized, as compared with the case where the side of the microphone unit that corresponds to the first MEMS chip 13 is utilized, the vibration amplitude with respect to the distance from the sound source is significantly decreased, and the distance attenuation is increased.

In other words, when the side of the microphone unit that corresponds to the first MEMS chip 13 is utilized, as compared with the case where the side of the microphone unit that corresponds to the second MEMS chip 15 is utilized, the microphone unit 1 has the excellent function of receiving far-sound where the sound source is located in a position far away from the microphone unit 1. On the other hand, when the side of the microphone unit that corresponds to the second MEMS chip 15 is utilized, the microphone unit 1 has the excellent function of efficiently receiving a target sound produced near the microphone unit 1 and removing background noise (indicating sounds other than the target sound).

The latter case will be further described. The sound pressure of the target sound produced near the microphone unit 1 is significantly attenuated between the first sound hole 23 and the second sound hole 25; the sound pressure transmitted to the upper surface of the second diaphragm 154 greatly differs from the sound pressure transmitted to the lower surface of the second diaphragm 154. On the other hand, since, in the background noise, the sound source is located far away as compared with the target sound, the background noise is little attenuated between the first sound hole 23 and the second sound hole 25, with the result that the difference between the sound pressure transmitted to the upper surface of the second diaphragm 154 and the sound pressure transmitted to the lower surface of the second diaphragm 154 is significantly decreased. Here, it is assumed that the distance from the sound source to the first sound hole 23 differs from the distance from the sound source to the second sound hole 25.

Since the difference between the sound pressures of the background noise received by the second diaphragm 154 is significantly small, the sound pressures of the background noise are nearly cancelled out in the second diaphragm 154. By contrast, since the difference between the sound pressures of the target sound received by the second diaphragm 154 is large, the sound pressures of the target sound are not cancelled out in the second diaphragm 154. Hence, signals obtained by the vibration of the second diaphragm 154 are regarded as the signals of the target sound where the background noise is removed. Therefore, when the side of the microphone unit that corresponds to the second MEMS chip 15 is utilized, the microphone unit 1 has the excellent function of removing the background noise and receiving the target sound generated near the microphone unit 1.

As described above, in the microphone unit 1, the signals taken out from the first MEMS chip 13 and the signals taken out from the second MEMS chip 15 are separately processed (amplification processing), and are separately output to the outside. Hence, in a sound input device to which the microphone unit 1 is applied, any one of the signals output from the two MEMS chips 13 and 15 is, as necessary, selected and used, depending on whether the purpose is to receive the sound of a nearby sound source or to receive the sound of a far away sound source, and thus it is possible to achieve multifunctionality of the sound input device.

A case where the microphone unit 1 is applied to a mobile telephone (an example of a sound input device) will be described as a specific example. When the user makes a call over the mobile telephone, the user generally talks with the microphone unit 1 close to the mouth of the user. Hence, when the user makes a call over the mobile telephone, it is preferable to be able to remove the background noise and receive only the target sound. Hence, for example, at the time of call, it is preferable to use the signals taken out from the second MEMS chip 15 among the signals output from the microphone unit 1.

As described above, mobile telephones today have the hands-free function and the video recording function. When the mobile telephone is used in such a mode, it is necessary to be able to receive a sound far away from the microphone unit 1. Hence, for example, when the hands-free function or the video recording function of the mobile telephone is used, it is preferable to be able to use the signals taken out from the first MEMS chip 13 among the signals output from the microphone unit 1. Here, since the input sound pressure of the far-sound is low relative to that of the near-sound, a high SNR is required.

As described above, the microphone unit 1 of the present embodiment functions both as a bidirectional differential microphone having the excellent performance of far noise suppression (near-field sound reception function) and as an omnidirectional microphone that can receive the far-sound of a sound source located far away from the microphone unit 1 (far-field sound reception function). Hence, with the microphone unit 1 of the present embodiment, the functionality of the sound input device to which the microphone unit is applied is easily achieved.

Figure 26:
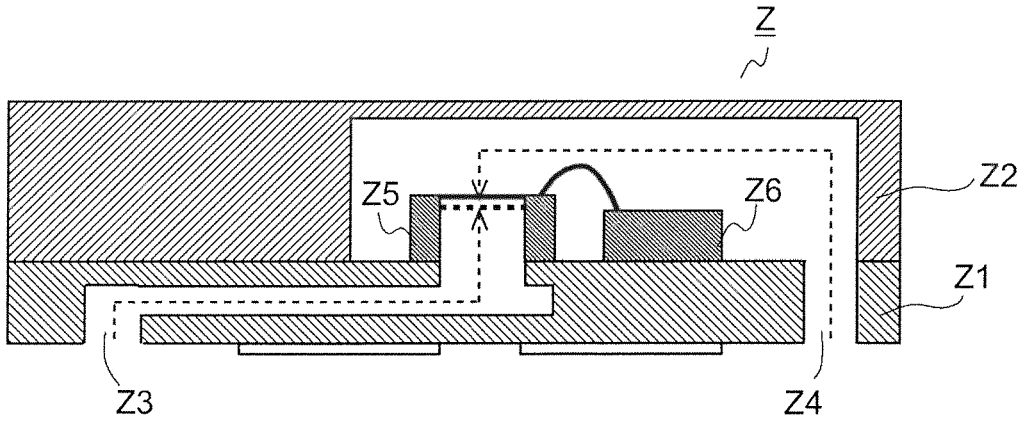
[FIG. 26] A schematic cross-sectional view showing the configuration of a conventional microphone unit.

In the microphone unit 1 of the present embodiment, part of the sound path of the first diaphragm 134 and part of the sound path of the second diaphragm 154 are shared, and spaces of the enclosure are shared, and thus the size of the package is reduced. Specifically, in a conventional microphone Z functioning only as a close-talking microphone, as shown in FIG. 26, a given distance (for example, 5 mm) is physically required between a first sound hole Z3 and a second sound hole Z4 (both of which are formed in the lower surface side of a mounting portion Z1). Hence, in an upper portion, a lid portion Z2, of the first sound hole Z3, a useless region that is not acoustically used is produced. In the microphone unit 1 of the present embodiment, the first holding space 121 is provided in this region, the first MEMS chip 13 and the first ASIC 14 are arranged and the region is effectively used, with the result that the size of the microphone unit is reduced. In FIG. 26, symbol Z5 represents the MEMS chip and symbol Z6 represents the ASIC.

Since the microphone unit 1 of the present embodiment has the two functions described above, it is not necessary to separately mount two microphones having different functions as is conventionally needed. Hence, when a multifunctional sound input device is manufactured, it is possible to decrease the number of members used and decrease (reduce the increase in the size of the sound input device) the area of mounting of the microphone.

Since, in the microphone unit 1 of the present embodiment, the airtight space (back room) facing the upper surface of the first diaphragm 134 is obtained by utilizing the concave portion 12*b* formed in the lid portion 12, the volume of the back room is easily increased. This facilitates the enhancement of the SNR of the microphone.

Figure 12:
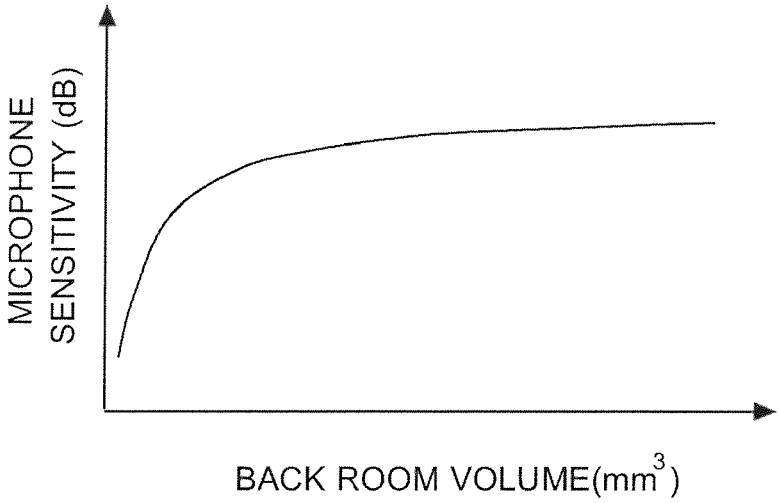
[FIG. 12] A graph showing the relationship between a back room volume and a microphone sensitivity in a microphone.

FIG. 12 is a graph showing the relationship between the back room volume and the microphone sensitivity in the microphone. FIG. 12 shows that, as the back room volume is increased, the microphone sensitivity is enhanced, and that, as the back room volume is decreased, the sensitivity is rapidly lowered. When a small-sized microphone is used, it is difficult to sufficiently acquire the volume of the back room, and the microphone is often designed for a region where wide variations in the sensitivity for the back room volume are produced. In this case, it is found that the microphone sensitivity is significantly enhanced by only slightly increasing the back room volume.

Figure 13:
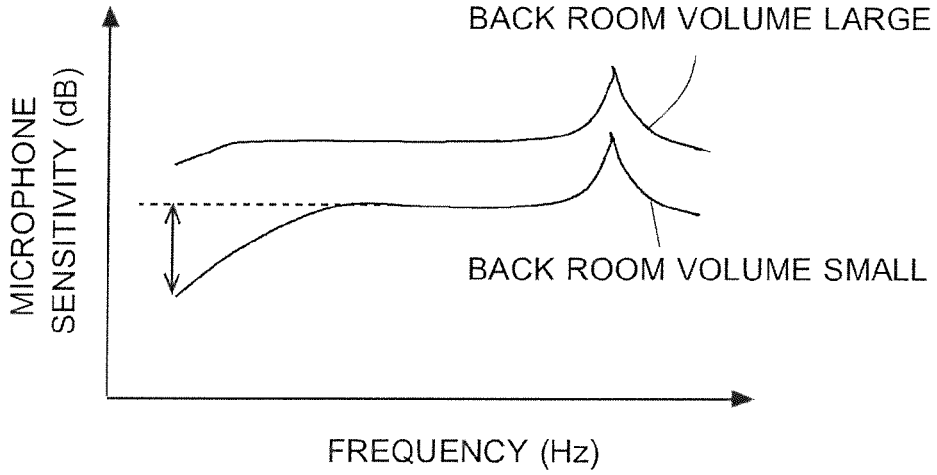
[FIG. 13] A graph for illustrating that the relationship between the microphone sensitivity and a frequency is varied by the back room volume.

FIG. 13 is a graph for illustrating the fact that the relationship between the microphone sensitivity and the frequency is varied by the back room volume. FIG. 13 shows that, as the back room volume is increased, the microphone sensitivity is enhanced, and that, when the back room volume is small, the microphone sensitivity is attenuated in a low-frequency region. The characteristic described above is determined by a balance between the spring constant of the diaphragm and the spring constant of the air within the holding space. As described above, in the microphone unit 1 of the first embodiment, the back room volume facing the upper surface of the first diaphragm 134 is easily increased, and thus the microphone sensitivity is easily enhanced. Hence, when the first MEMS chip 13 is used to receive the far-sound of a sound source located far away from the microphone unit 1, it is possible to increase the SNR of the signal output form the microphone unit 1.

In the microphone unit 1 of the present embodiment, the lid portion 12 can be formed of a metallic material, such as aluminum, brass, iron or cupper, that is conductive in addition to a resin material such as a LCP or a PPS, a glass epoxy material such as FR-4 and a ceramic material. A metallic portion is connected to the mounting portion 11 or the GND portion of a user substrate, and thus it is possible to acquire an electromagnetic shield effect. Even when an insulating material such as a resin material, a glass epoxy material or a ceramic material is used, its surface is subjected to conductive plating processing, and thus the insulating material can have the same effect of an electromagnetic shield as a metal. Specifically, the external wall surfaces of the upper portion and the side portion of the lid portion 12 are subjected to conductive plating (metal plating), and the conductively plated portions are connected to the mounting portion 11 or the GND portion of the user substrate, with the result that it is possible to acquire an electromagnetic shield effect.

In order to reduce the thickness of a microphone, it is necessary to reduce the thickness of individual components. However, when a resin material and a glass epoxy material have a thickness of 0.2 mm or less, the strength thereof is significantly lowered. Hence, for example, it is likely that an external sound pressure applied to a wall surface causes an external wall to vibrate, and that the sound reception function of the microphone itself will be adversely affected. A conductive metal film is formed on the external wall surface of the lid portion 12, and thus it is possible to increase the mechanical strength of the lid portion 12 and thereby increase resistance to an external stress; it is also possible to achieve the sound reception function of the microphone itself by reducing unnecessary vibrations.

Variations of the microphone unit 1 according to the first embodiment will now be described.

Figure 14:
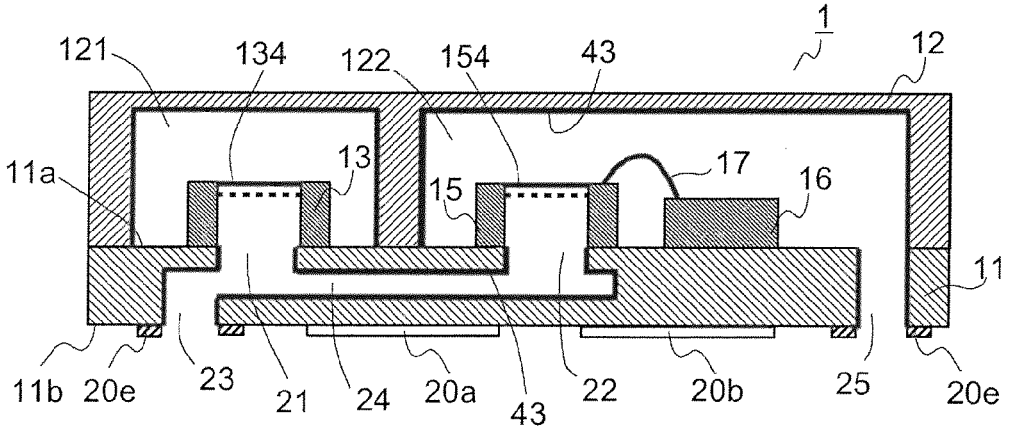
[FIG. 14] A cross-sectional view for illustrating a first variation of the microphone unit according to the first embodiment.

FIG. 14 is a cross-sectional view for illustrating a first variation of the microphone unit according to the first embodiment. FIG. 14 is a cross-sectional view similar to FIG. 3. In the first variation of the microphone unit 1, on the inner wall surface of the sound path provided within the mounting portion 11 of the enclosure 10 and the inner wall of the lid portion 12, coating layers 43 are formed.

For example, when a substrate material such as FR-4 is used as the material of the mounting portion 11 or the lid portion 12, fibrous dust is easily produced from a cut surface (processed surface). For example, when such dust enters the internal portion between the electrodes through the through holes 132*a* and 152*a* (see FIG. 6) provided in the fixed electrodes 132 and 152 of the MEMS chips 13 and 15, the spaces between the fixed electrodes 132 and 152 and the diaphragms 134 and 152 are blocked, and thus the MEMS chips 13 and 15 disadvantageously malfunction. In this point, as in the first variation, the coating layers 43 are formed, and thus it is possible to prevent the occurrence of minute dust and solve the problem described above.

The coating layers 43 may be obtained by utilizing a plating processing technology that is often used in the manufacturing of substrates; more specifically, the coating layers 43 may be obtained by, for example, Cu plating processing or Cu+Ni plating processing. The coating layers 43 may be obtained by performing a coating processing on a resist material that can be subjected to exposure and development. The coating layer 43 may be formed with a plurality of layers; for example, after a Cu plating processing, the resist material is further subjected to a coating processing, with the result that the coating layer may be obtained. In the microphone unit 1, the sealing electrode pad 20*e* is formed around the first sound hole 23 and the second sound hole 25 (see FIG. 1B and the like). In this configuration, when the microphone unit 1 is mounted in a sound input device such as a mobile telephone, solder flows into the first sound hole 23 and the second sound hole 25, and thus the sound path may be narrowed and blocked. One effective way to prevent this problem is to coat the Cu plating with a material that repels the solder, such as a resist, to prevent the entrance of the solder.

In the first variation shown in FIG. 14, the coating layers 43 (Cu plating as a specific example) provided on the mounting portion 11 and the lid portion 12 may be connected to a fixed potential (GND or power supply). The coating layers 43 provided on the mounting portion 11 can enhance resistance to an external electromagnetic field from below the MEMS chips 13 and 15. The coating layers 43 provided on the lid portion 12 can enhance the resistance to an external electromagnetic field from above the MEMS chips 13 and 15. In this way, an electromagnetic shield can be provided on both the upper and lower sides of the MEMS chips 13 and 15, and thus it is possible to significantly enhance the resistance to external electromagnetic fields (to prevent the entrance of external electromagnetic field noise).

Although, in the first variation, the coating layers 43 are provided on the mounting portion 11 and the lid portion 12, the present invention is not limited to this configuration. For example, the coating layer 43 may be provided on only the mounting portion 11 (that is, on only the wall surface of the sound path provided within the mounting portion 11).

Figure 15:
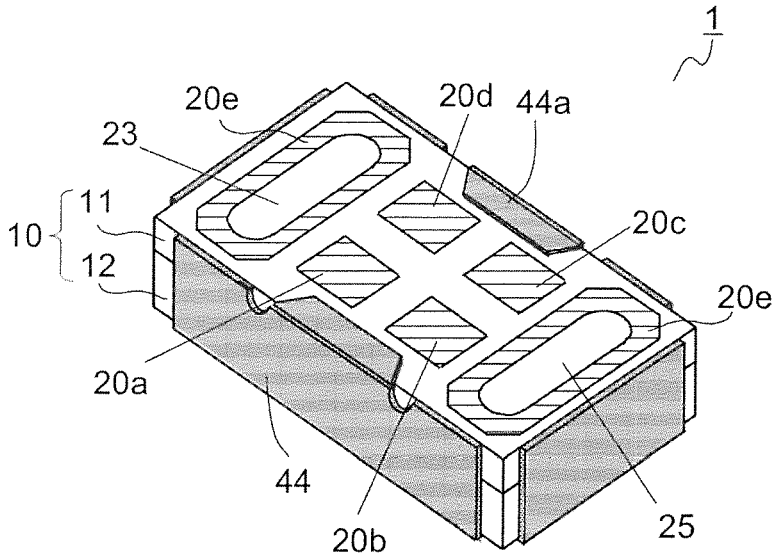
[FIG. 15] A perspective view for illustrating a second variation of the microphone unit according to the first embodiment.

FIG. 15 is a perspective view for illustrating a second variation of the microphone unit according to the first embodiment. In the second variation of the microphone unit 1, a shield cover 44 is provided so as to cover the enclosure 10 (formed with the mounting portion 11 and the lid portion 12) of the microphone unit 1.

The shield cover 44 formed of a conductive material (metal) is formed substantially in the shape of a box, is placed from the side of the lid portion 12 to cover the enclosure 10 and is connected to the fixed potential (GND). The shield cover 44 is fixed to the enclosure 10 by crimping; crimping regions 44*a* are provided in the shield cover 44. The enclosure 10 is covered with the shield cover 44 in this way, and thus it is possible to enhance the resistance to an external electromagnetic field (to prevent the entrance of external electromagnetic field noise). It is appropriate to set the thickness of the metal at about 50 to 200 μm. In the present variation, since the entire microphone enclosure is covered with the metal plate, it is possible to obtain a high electromagnetic shield effect.

Figure 16:
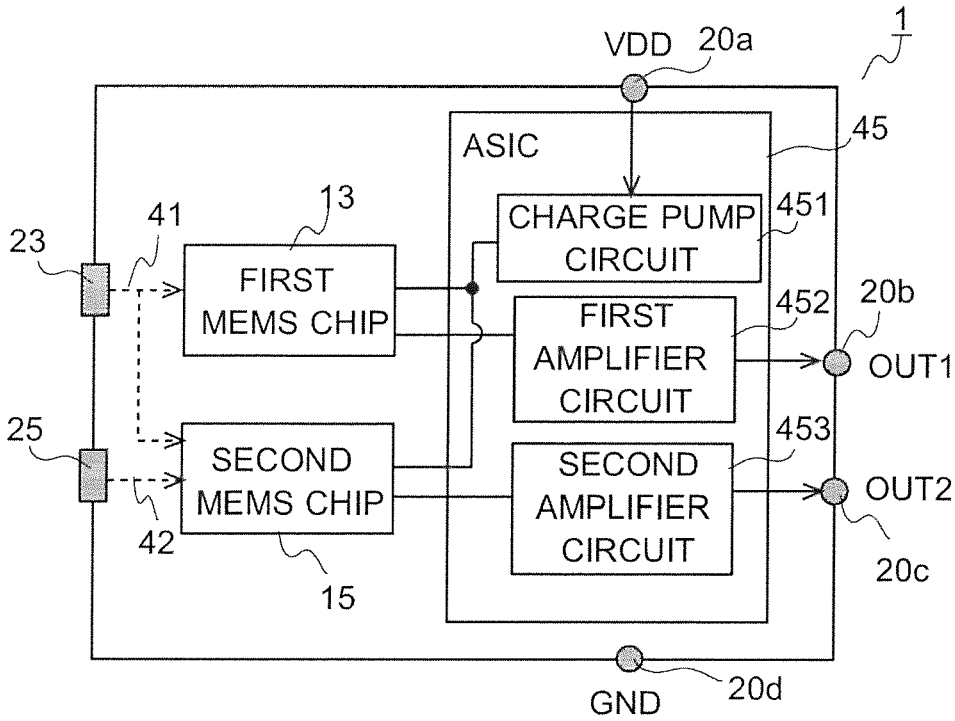
[FIG. 16] A block diagram for illustrating a third variation of the microphone unit according to the first embodiment.

FIG. 16 is a block diagram for illustrating a third variation of the microphone unit according to the first embodiment. In the third variation of the microphone unit 1, the first ASIC 14 held in the first holding space 121 (see FIG. 3) and the second ASIC 16 held in the second holding space 122 (see FIG. 3) are integrated, and thus the number of ASICs is set at one (the space reduction effect is provided).

Figure 17:
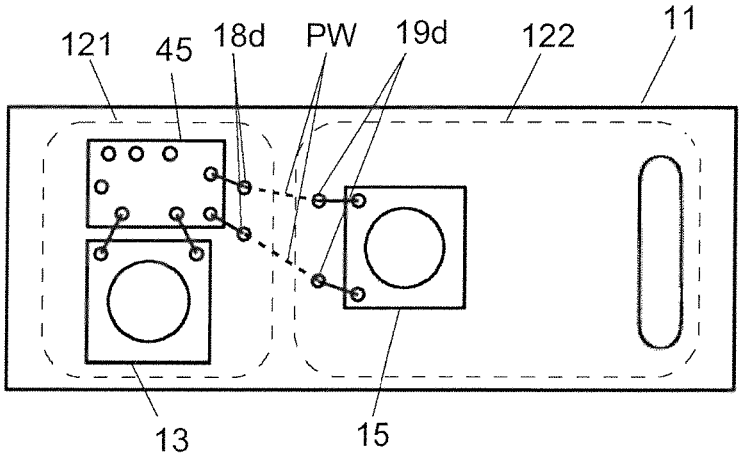
[FIG. 17] A diagram for illustrating the configuration of the third variation of the microphone unit according to the first embodiment, showing a schematic plan view of the mounting portion incorporated in the microphone unit, as seen from above.

An example of the arrangement of the MEMS chips and the ASIC on the mounting portion 11 in this case will be shown in FIG. 17. FIG. 17 is a diagram for illustrating the configuration of the third variation of the microphone unit according to the first embodiment; FIG. 17 is also a schematic plan view of the mounting portion incorporated in the microphone unit, as seen from above. For ease of understanding, FIG. 17 also shows the holding spaces 121 and 122. The first MEMS chip 13 and an ASIC 45 are arranged in the first holding space 121; the second MEMS chip 15 is arranged in the second holding space 122. In this configuration, it is impossible to directly connect the ASIC 45 and the second MEMS chip 15 with wires. Hence, for example, preferably, wires taken out from the second MEMS chip 15 are connected to electrode terminals 19*d* on the mounting portion 11, wires taken out from the ASIC 45 are connected to electrode terminals 18*d* on the mounting portion 11 and the electrode terminals 18*d* and the electrode terminals 19*d* are connected by a wiring pattern PW (represented by dotted lines) formed on the mounting portion 11. The ASIC 45 may be arranged in the second holding space 122.

Figure 18:
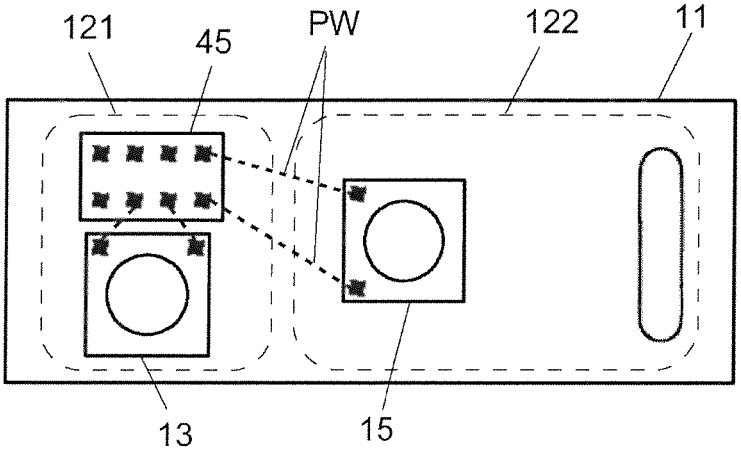
[FIG. 18] A diagram for illustrating another configuration of the third variation of the microphone unit according to the first embodiment, showing a schematic plan view of the mounting portion incorporated in the microphone unit, as seen from above.

Another example of the arrangement of the MEMS chips and the ASIC will be shown in FIG. 18. FIG. 18 is a diagram for illustrating another configuration of the third variation of the microphone unit according to the first embodiment; FIG. 18 is also a schematic plan view of the mounting portion incorporated in the microphone unit, as seen from above. As in FIG. 17, FIG. 18 also shows the holding spaces 121 and 122. The first MEMS chip 13 and the ASIC 45 are arranged in the first holding space 121; the second MEMS chip 15 is arranged in the second holding space 122. Since, in this configuration, it is impossible to electrically and directly connect the ASIC 45 and the second MEMS chip 15 with wires, all the first MEMS chip 13, the second MEMS chip 15 and the ASIC 14 are flip-chip mounted on the mounting portion 11. An electrode pad is provided on the back surface of the chip, an electrode is provided, on the side of the mounting portion 11, to face the electrode pad of the chip and both of them are joined by soldering or the like. On the mounting portion 11, the wiring pattern PW (represented by dotted lines) for wiring these electrodes is provided.

The ASIC 45 includes a charge pump circuit 451 that applies a bias voltage to the first MEMS chip 13 and the second MEMS chip 15. The charge pump circuit 451 steps up (for example, to about 6 to 10 volts) the power supply voltage VDD (for example, about 1.5 to 3 volts), and thereby applies the bias voltage to the first MEMS chip 13 and the second MEMS chip 15. The ASIC 45 includes a first amplifier circuit 452 that detects variations in the capacitance of the first MEMS chip 13 and a second amplifier circuit 453 that detects variations in the capacitance of the second MEMS chip 15. The electrical signals amplified by the first amplifier circuit 452 and the second amplifier circuit 453 are independently output from the ASIC 45.

In the microphone unit 1 of the third variation, electrical signals take out based on variations in the capacitance of the first MEMS chip 13 are amplified by the first amplifier circuit 452 and are finally output form the first output electrode pad 20*b*. Electrical signals take out based on variations in the capacitance of the second MEMS chip 15 are amplified by the second amplifier circuit 452 and are finally output form the second output electrode pad 20*c*.

Although, here, a common bias voltage is applied to the first MEMS chip 13 and the second MEMS chip 15, the present invention is not intended to be limited to this configuration. For example, two charge pump circuits may be provided, and bias voltages may be separately applied to the first MEMS chip 13 and the second MEMS chip 15. In this configuration, it is possible to reduce the possibility that cross talk occurs between the first MEMS chip 13 and the second MEMS chip 15.

The amplification gains of the two amplifier circuits 452 and 453 may be set different from each other. Here, the amplification gain of the second amplifier circuit 453 is preferably made greater than that of the first amplifier circuit 452.

Figure 19:
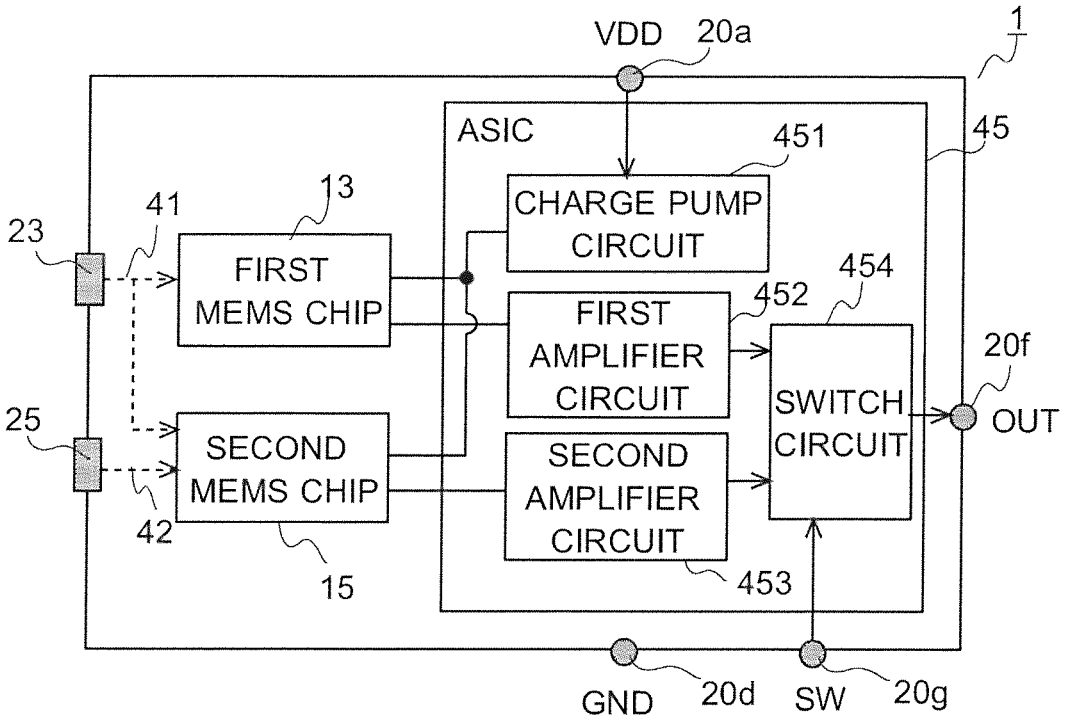
[FIG. 19] A block diagram for illustrating a fourth variation of the microphone unit according to the first embodiment.

FIG. 19 is a diagram for illustrating a fourth variation of the microphone unit according to the first embodiment. In the microphone unit 1 of the fourth variation, as in the third variation, the number of ASICs is also set at one. However, the fourth variation differs from the third variation in the following respect. Specifically, in the microphone unit 1 of the fourth variation, a switch electrode pad 20*g* for inputting a switch signal from the outside (the sound input device in which the microphone unit 1 is mounted) is provided (provided outside the enclosure 10 as an external connection electrode pad). By the switch signal fed through the switch electrode pad 20*g*, a switch circuit 454 provided in the ASIC 45 is operated. In this respect, the microphone unit 1 of the fourth variation differs from that of the third variation. The fourth variation also differs from the third variation in that the number of output electrode pads for output to the outside is one (the output electrode pad 20*f*).

As shown in FIG. 19, the switch circuit 454 is a circuit that switches which of the signal output from the first amplifier circuit 452 and the signal output from the second amplifier circuit 453 is output to the outside. Specifically, in the microphone unit 1 of the fourth variation, only any one of the signal taken out from the first MEMS chip 13 and the signal taken out from the second MEMS chip 15 is output to the outside through the output electrode pad 20*f*. In the fourth variation, on the side of the sound input device incorporating the microphone unit 1, it is not necessary to perform a switch operation on which of the two input sound signals is used.

In the switch operation of the switch circuit 454 with the switch signal, for example, the H (high level) and the L (low level) of the signal are preferably used. Although, in the fourth variation, the common bias voltage is applied to the first MEMS chip 13 and the second MEMS chip 15, the present invention is not limited to this configuration. Another configuration may be employed. Specifically, for example, the switch signal and the switch circuit may be used to switch which of the first MEMS chip 13 and the second MEMS chip 15 is electrically connected to the charge pump circuit 451. In this way, it is possible to reduce the possibility that cross talk occurs between the first MEMS chip 13 and the second MEMS chip 15.

Figure 20:
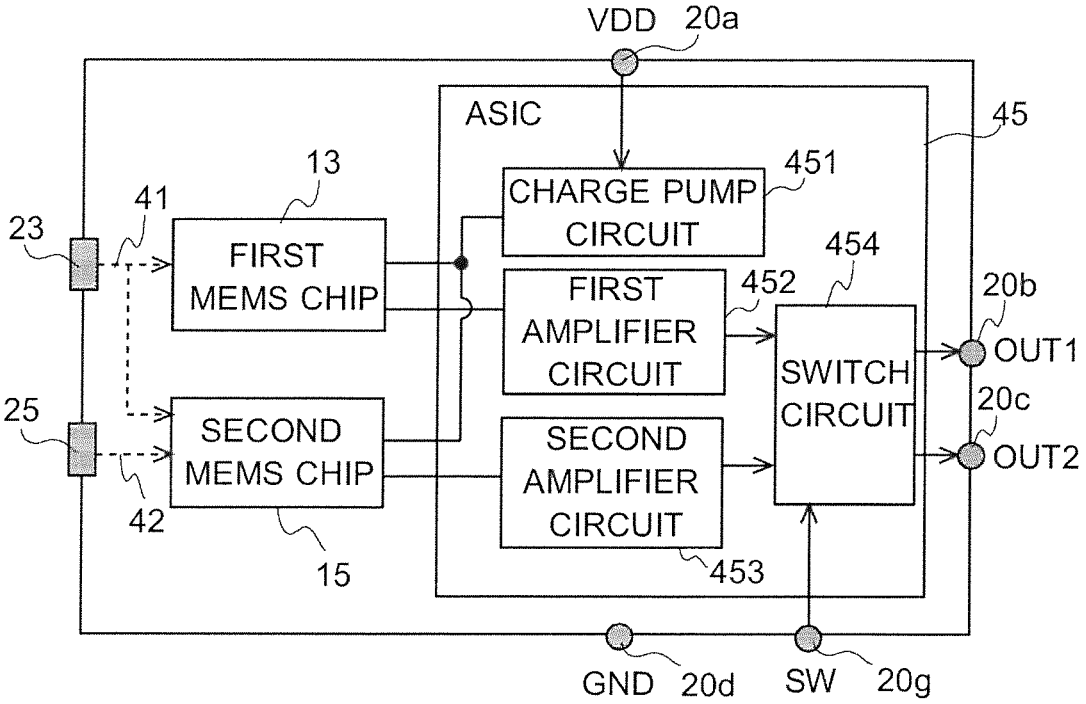
[FIG. 20] A block diagram for illustrating a fifth variation of the microphone unit according to the first embodiment.

FIG. 20 is a block diagram for illustrating a fifth variation of the microphone unit according to the first embodiment. In the microphone unit 1 of the fifth variation, as in the fourth variation, the switch electrode pad 20*g* for inputting the switch signal from the outside and the switch circuit 454 that is provided in the ASIC 45 and that performs the switch operation with the switch signal fed through the switch electrode pad 20*g* are incorporated. However, the fifth variation differs from the fourth variation in that the two output electrode pads for output to the outside (the first output electrode pad 20*b* and the second output electrode pad 20*c*) are provided.

The switch circuit 454 switches from which of the two output electrode pads 20*b* and 20*c* the signal output from the first amplifier circuit 452 and the signal output form the second amplifier circuit 453 are output.

Specifically, when the switch circuit 454 is brought into a first mode by the switch signal input from the switch electrode pad 20*g*, a signal corresponding to the first MEMS chip 13 is output from the first output electrode pad 20*b*, and a signal corresponding to the second MEMS chip 15 is output from the second output electrode pad 20*c*. On the other hand, when the switch circuit 454 is brought into a second mode by the switch signal, a signal corresponding to the second MEMS chip 15 is output from the first output electrode pad 20*b*, and a signal corresponding to the first MEMS chip 13 is output from the second output electrode pad 20*c*.

When manufacturers of the microphone unit and the sound input device are different from each other, as to the manufacturer of the sound input device, the following types of manufacturers are expected to be present.

(A) One type of manufacturer desires that both the signal corresponding to the first MEMS chip 13 and the signal corresponding to the second MEMS chip 15 are output from the microphone unit.

(B) One type of manufacturer desires that any one of the signal corresponding to the first MEMS chip 13 and the signal corresponding to the second MEMS chip 15 is output from the microphone unit by the switching of the switch signal.

In this respect, it is convenient for only the microphone unit 1 of the fifth variation to fulfill the needs of both the manufacturers (A) and (B) described above.

A sixth variation of the microphone unit according to the first embodiment will be described. In the sixth variation, the sealing electrode pad 20*e* is used as, for example, the GND electrode pad or the power supply electrode pad for the input of the power supply voltage (VDD). As specific examples, there are examples below: both the two sealing electrode pads 20*e* being used as the GND electrode pad; and one of the two sealing electrode pads 20*e* being used as the GND electrode pad and the other being used as the power supply electrode pad.

In this configuration, it is possible to reduce the number of external connection electrode pads 20 formed on the external surface (the lower surface 11*b* of the mounting portion 11) of the enclosure 10. When the number of external connection electrode pads 20 is reduced, since the size of each of the electrode pads provided on the external surface of the enclosure 10 can be increased, it is possible to increase, in each of the electrode pads, the strength of the joining to the mounting substrate of the sound input device (such as a mobile telephone). In the configuration in which both the two sealing electrode pads 20*e* are used as the GND electrode pad, the sealing electrode pads 20*e* provided around the sound holes 23 and 25 are continuously formed to reach the inside of the sound holes 23 and 25 (through-hole plating is performed on the inner walls of the sound holes 23 and 25), and thus the GND is strengthened, with the result that it is also possible to enhance the resistance to an external electromagnetic field (to prevent the entrance of external electromagnetic field noise).

The configuration of the sixth variation is advantageous over the configuration (see FIG. 15) in which the shield cover 44 as described in the second variation covers the enclosure 10. Specifically, when the enclosure 10 is small, it is difficult to acquire the crimping regions 44*a*. However, since, in the sixth variation, the number of external connection electrode pads 20 can be reduced, the crimping regions 44*a* are easily acquired.

2. Microphone Unit of a Second Embodiment

Figure 21:
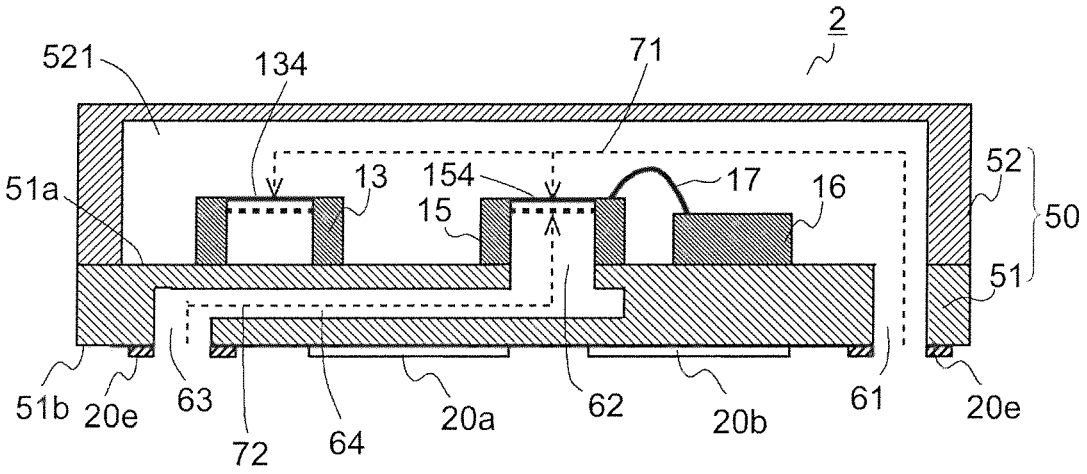
[FIG. 21] A schematic cross-sectional view showing the configuration of a microphone unit according to a second embodiment.

A microphone unit of a second embodiment will now be described. FIG. 21 is a schematic cross-sectional view showing the configuration of the microphone unit according to the second embodiment. The position along which FIG. 21 is taken is the same as in FIG. 3. The same parts as in the microphone unit 1 of the first embodiment are identified with like symbols, and then a description will be given.

In the microphone unit 2 of the second embodiment, as in the microphone unit 1 of the first embodiment, the first MEMS chip 13, the first ASIC 14, the second MEMS chip 15 and the second ASIC 16 are held in an enclosure 50 formed with a mounting portion 51 and a lid portion 52. Since the configurations of the MEMS chips 13 and 15 and the ASICs 14 and 16 and their positional and connection relationships are the same as in the microphone unit 1 of the first embodiment, their description will not be repeated.

As in the microphone unit 1 of the first embodiment, the mounting portion 51 is formed by bonding, for example, a plurality of flat plates.

A through hole 61 (formed substantially in the shape of a rectangle as seen in a plan view) that penetrates a mounting surface (upper surface) 51*a* on which the MEMS chips 13 and 15 and the ASICs 14 and 16 are mounted and its back surface (lower surface) 51*b* is formed close to one end (close to the right of FIG. 21) of the mounting portion 51 in the longitudinal direction. Since the through hole 61 is a sound hole for inputting sound into the enclosure 50, in the following description, it is expressed as a first sound hole 61. The shape of the first sound hole 61 and the position where the first sound hole 61 is formed are the same as those of the second sound hole 25 according to the first embodiment.

In an approximate center portion (to be precise, slightly close to the right from the center in the longitudinal direction) of the mounting surface 51*a* of the mounting portion 51, an opening portion 62 that is covered with the second MEMS chip 15 (substantially in the shape of a circle as seen in a plan view) is provided. In the back surface 51*b* of the mounting surface 51*a* of the mounting portion 51, an opening portion 63 (hereinafter expressed as a second sound hole 63) that forms a second sound hole and that is formed substantially in the shape of a rectangle as seen in a plan view is formed. Within the mounting portion 51, a hollow space 64 (substantially in the shape of a letter T as seen in a plan view) that makes the opening portion 62 communicate with the second sound hole 63 is formed. The shapes of the opening portion 62, the second sound hole 63 and the hollow space 64 are respectively the same as those of the second opening portion 22, the first sound hole 23 and the hollow space 24 in the microphone unit 1 of the first embodiment.

In the mounting portion 51, wiring and electrode pads (including the sealing electrode pad 20*e*) are formed that are the same as in the mounting portion 11 of the microphone unit 1 according to the first embodiment.

The outside shape of the lid portion 52 is formed substantially in the shape of a rectangular parallelepiped; the lengths of the lid portion 52 in its longitudinal direction (the left/right direction of FIG. 21) and its widthwise direction (the direction perpendicular to the plane of FIG. 21) are adjusted such that, when the lid portion 52 covers the mounting portion 51 to form an enclosure 50, the side surface portions of the enclosure 50 are substantially flush. The lid portion 52 differs from the lid portion 12 of the microphone unit 1 according to the first embodiment in that no division portion is provided therewithin, and that the lid portion 52 includes only one concave portion. Hence, as shown in FIG. 21, the lid portion 52 covers the mounting portion 51, and thus one holding space 521 that holds the two MEMS chips 13 and 15 and the two ASICs 14 and 16 is obtained.

In the microphone unit 2 of the second embodiment that is configured as described above, as shown in FIG. 21, sound waves input through the first sound hole 61 reach one surface (upper surface) of the first diaphragm 134 through the holding space 521, and also reach one surface (upper surface) of the second diaphragm 154. Sound waves input through the second sound hole 63 reach the other surface (lower surface) of the second diaphragm 154 through the hollow space 64 and the opening portion 62.

In other words, in the microphone unit 2, a first sound path 71 that transmits sound waves input through the first sound hole 61 to one surface of the first diaphragm 134 and that also transmits them to one surface of the second diaphragm 154 is formed with the first sound hole 61 and the holding space 521. Moreover, a second sound path 72 that transmits sound waves input through the second sound hole 63 to the other surface of the second diaphragm 154 is formed with the second sound hole 63, the hollow space 64 and the opening portion 62. Sound waves are prevented from being input from the outside through the other surface of the first diaphragm 134, and thus an airtight space (back room) without acoustic leakage is formed.

When sound is produced outside the microphone unit 2, the sound waves input through the first sound hole 61 reach the upper surface of the first diaphragm 134 through the first sound path 71, and the first diaphragm 134 vibrates. Thus, variations in the capacitance of the first MEMS chip 13 are produced. Electrical signals taken out based on variations in the capacitance of the first MEMS chip 13 are subjected to amplification processing by the amplifier circuit 142 of the first ASIC 14 (which is not shown in FIG. 21 but is present behind the plane of the figure with respect to the first MEMS chip 13), and are finally output from the first output electrode pad 20*b*.

Moreover, when sound is produced outside the microphone unit 2, the sound waves input through the first sound hole 61 reach the upper surface of the second diaphragm 154 through the first sound path 41, and sound waves input through the second sound hole 63 reach the lower surface of the second diaphragm 154 through the second sound path 42. Hence, the second diaphragm 154 is vibrated by the difference between the sound pressure applied to the upper surface and the sound pressure applied to the lower surface. Thus, variations in the capacitance of the second MEMS chip 15 are produced. Electrical signals taken out based on variations in the capacitance of the second MEMS chip 15 are subjected to amplification processing by the amplifier circuit 162 of the second ASIC 16, and are finally output from the second output electrode pad 20*c*.

As with the microphone unit 1 of the first embodiment, the microphone unit 2 of the second embodiment functions both as a bidirectional differential microphone (obtained by using the signals taken out from the second MEMS chip 15) having the excellent function of far noise suppression and as an omnidirectional microphone that can receive far-sound (obtained by using the signals taken out from the first MEMS chip 13). Hence, with the microphone unit 2 of the second embodiment, the functionality of the sound input device to which the microphone unit is applied is also easily achieved.

Since the microphone unit 2 of the second embodiment has the two functions described above, in order to acquire the two functions, it is not necessary to separately mount two microphones each having one of the two different functions, as is conventionally needed. Hence, when a multifunctional sound input device is manufactured, it is possible to decrease the number of members used and to decrease the area of mounting of the microphone (reduce the increase in the size of the sound input device).

The variations 1 to 6 of the first embodiment can also be applied to the microphone unit 2 of the second embodiment.

(Sound Input Device to which the Microphone Unit of the Present Invention is Applied)

An example of the configuration of the sound input device to which the microphone unit of the present invention is applied will now be described. Here, a case where the sound input device is a mobile telephone will be described as an example. Moreover, a case where the microphone unit is the microphone unit 1 of the first embodiment will be described as an example.

Figure 22:
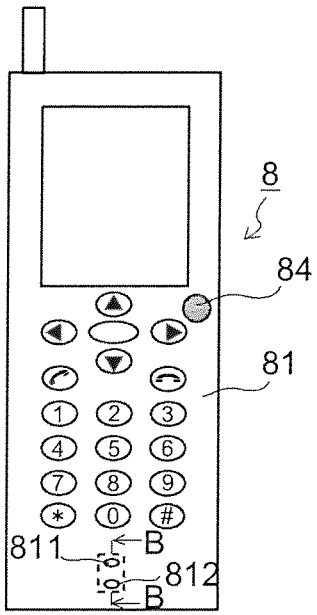
[FIG. 22] A plan view showing the schematic configuration of an embodiment of a mobile telephone to which the microphone unit of the first embodiment is applied.
Figure 23:
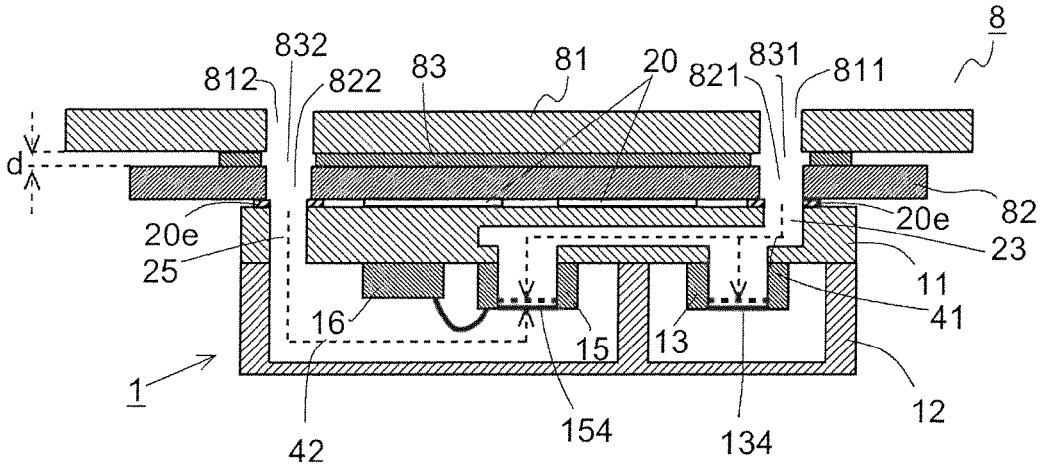
[FIG. 23] A schematic cross-sectional view taken along position B-B of FIG. 22.

FIG. 22 is a plan view showing the schematic configuration of an embodiment of the mobile telephone to which the microphone unit of the first embodiment is applied. FIG. 23 is a schematic cross-sectional view taken along position B-B of FIG. 22. As shown in FIG. 22, two sound holes 811 and 812 are provided in the side of the lower portion of the enclosure 81 of the mobile telephone 8; the sound of the user is input into the microphone unit 1 arranged within the enclosure 81 through these two sound holes 811 and 812.

As shown in FIG. 23, within the enclosure 81 of the mobile telephone 8, a mounting substrate 82 on which the microphone unit 1 is mounted is incorporated. On the mounting substrate 82, a plurality of electrode pads electrically connected to a plurality of external connection electrode pads 20 (including the sealing electrode pad 20*e*) incorporated in the microphone unit 1 are provided. The microphone unit 1 is fixed to the mounting substrate 82 by being electrically connected to the mounting substrate 82 with, for example, solder. Thus, a power supply voltage is applied to the microphone unit 1, and electrical signals output from the microphone unit 1 are fed to a sound signal processing portion (not shown) provided on the mounting substrate 82.

In the mounting substrate 82, through holes 821 and 822 are provided in positions corresponding to the two sound holes 811 and 812 provide in the enclosure 81 of the mobile telephone 8. Between the enclosure 81 of the mobile telephone 8 and the mounting substrate 82, a gasket 83 is arranged so that airtightness is maintained without the occurrence of acoustic leakage. In the gasket 83, through holes 831 and 832 are provided in positions corresponding to the two sound holes 811 and 812 provided in the enclosure 81 of the mobile telephone 8.

The microphone unit 1 is arranged such that the first sound hole 23 is overlaid on the through hole 821 provided in the mounting substrate 82 and that the second sound hole 25 is overlaid on the through hole 822 provided in the mounting substrate 82. When the microphone unit 1 is mounted on the mounting substrate 82, the sealing electrode pads 20*e* arranged around the first sound hole 23 and the second sound hole 25 are joined onto the mounting substrate 82 with solder. Hence, between the microphone unit 1 and the mounting substrate 82, airtightness is maintained without the occurrence of acoustic leakage.

Since the mobile telephone 8 is configured as described above, sound produced outside the enclosure 81 of the mobile telephone 8 is input through the sound hole 811 of the mobile telephone 8, reaches the first sound hole 23 of the microphone unit 1 through the through hole 831 (provided in the gasket 83) and the through hole 821 (provided in the mounting substrate 82) and further passes through the first sound path 41 to reach one surface (the upper surface in FIG. 23) of the first diaphragm 134 of the first MEMS chip 13 and to reach one surface (the upper surface in FIG. 23) of the second MEMS chip 15. Moreover, the sound produced outside the enclosure 81 of the mobile telephone 8 is input through the sound hole 812 of the mobile telephone 8, reaches the second sound hole 25 of the microphone unit 1 through the through hole 832 (provided in the gasket 83) and the through hole 822 (provided in the mounting substrate 82) and further passes through the second sound path 42 to reach the other surface (the lower surface in FIG. 23) of the second diaphragm 154 of the second MEMS chip 15.

In the mobile telephone 8 of the present embodiment, as shown in FIG. 22, there is provided a mode switch button 84 that swtiches a close-talking mode and a hands-free mode (which may include a video recording mode). In the sound signal processing portion (not shown) provided on the mounting substrate 82, when the close-talking mode is selected with the mode switch button 84, processing using a signal corresponding to the second MEMS chip 15 among the signals output from the microphone unit 1 is performed. When the hands-free mode (or the video recording mode) is selected with the mode switch button 84, processing using a signal corresponding to the first MEMS chip 13 among the signals output from the microphone unit 1 is performed. In this way, it is possible to perform the preferable signal processing in each of the modes.

Figure 24:
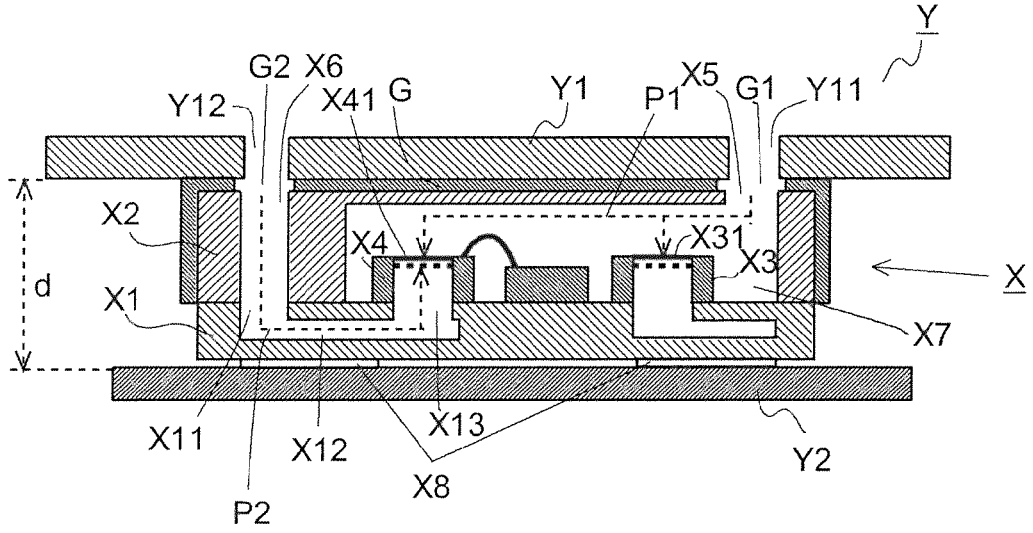
[FIG. 24] A schematic cross-sectional view of a mobile telephone in which a microphone unit disclosed in a previous application is mounted.

Incidentally, the present applicant has filed a patent application (JP-A-2009-293989) disclosing another aspect of a microphone unit that can switch, for example, between the close-talking mode and the hands-free mode. FIG. 24 is a schematic cross-sectional view of a mobile telephone on which the microphone unit disclosed in the previous application is mounted. The microphone unit X disclosed in the previous application differs from that of the present application in that sound holes (a first sound hole X5 and a second sound hole X6) are formed not in a mounting portion X1 on which MEMS chips X3 and X4 and the like are mounted but in a lid portion X2 which covers the mounting portion X1.

In the microphone unit X disclosed in the previous application, a first sound path P1 is formed that uses the first sound hole X5 formed in the lid portion X2 and a holding space X7 formed by the covering of the lid portion X2 on the upper surface of the mounting portion X1, thereby transmits sound waves input through the first sound hole X5 to one surface (the upper surface in FIG. 24) of a first diaphragm X31 and also transmits them to one surface (the upper surface in FIG. 24) of a second diaphragm X41. A second sound path P2 is formed that uses a second sound hole X6 formed in the lid portion X2, a first opening portion X11, a hollow space X12 and a second opening portion X13 formed in the mounting portion X1, and thereby transmits sound waves input through the second sound hole X6 to the other surface (the lower surface in FIG. 24) of the second diaphragm X41. Sound waves are not input from the outside through the other surface (lower surface) of the first diaphragm X31, and an airtight space (back room) without acoustic leakage is formed.

The microphone unit X disclosed in the previous application is, as shown in FIG. 24, mounted on a mounting substrate Y2 provided within the enclosure Y1 of a mobile telephone Y. On the mounting substrate Y2, a plurality of electrode pads electrically connected to a plurality of external connection electrode pads X8 incorporated in the microphone unit X are provided. The microphone unit X is electrically connected to the mounting substrate Y2 with, for example, solder. Thus, a power supply voltage is applied to the microphone unit X, and electrical signals output from the microphone unit X are fed to the sound signal processing portion (not shown) provided on the mounting substrate Y2.

The microphone unit X is arranged such that the first sound hole X5 is overlaid with a sound hole Y11 formed in the enclosure Y1 of the mobile telephone Y and that the second sound hole X6 is overlaid with a sound hole Y12 formed in the enclosure Y1 of the mobile telephone Y. Between the enclosure Y1 of the mobile telephone Y and the microphone unit X, a gasket G is arranged so that airtightness is maintained without the occurrence of acoustic leakage. In the gasket G, a through hole G1 is formed so as to be overlaid with the sound hole Y11 of the enclosure Y1 of the mobile telephone Y, and a through hole G2 is formed so as to be overlaid with the sound hole Y12 of the enclosure Y1 of the mobile telephone Y.

The advantages of the microphone units 1 and 2 (hereinafter represented as a lower-hole item) of the present invention over the microphone unit X (hereinafter represented as an upper-hole item) configured as discussed above will be described.

Since, in the lower-hole item, as compared with the upper-hole item, a gap d (see FIGS. 23 and 24) between the enclosure of the mobile telephone and the mounting substrate can be narrowed, it is possible to easily reduce the thickness of the mobile telephone. When, in the upper-hole item, the microphone unit X is attached to the mounting substrate Y2 such that the microphone unit X is inclined to the mounting substrate Y2, insufficient airtightness using the gasket G may be acquired. However, such a problem does not occur in the lower-hole item.

When, in the upper-hole item, the microphone unit X is mounted on the mounting substrate Y2, an assembly error may be produced in a direction within the plane of the mounting substrate Y2 or in a direction of thickness of the mounting substrate Y2. In consideration of the occurrence of the error in the direction within the plane, for example, it is disadvantageously necessary to increase, in the upper-hole item, the opening area of the through holes G1 and G2 provided in the gasket G. When the opening area of the through holes G1 and G2 in the gasket G is excessively increased, the area of contact between the gasket G and the microphone unit X cannot be sufficiently acquired, and thus insufficient airtightness may be acquired. Since insufficient airtightness may be acquired when the error is produced in the direction of the thickness described above, it is necessary to make a design such that the thickness of the gasket G is increased. In the lower-hole item, without any consideration of the assembly error of the microphone units 1 and 2 as described above, the gasket 83 can be designed, and thus the flexibility of design of the gasket 83 is enhanced.

Furthermore, in the upper-hole item, when it is incorporated in the mobile telephone Y, the microphone unit X is pressed with the gasket G having elasticity. Hence, a stress is applied to the MEMS chips X3 and X4, and thus there is a possibility that the sensitivity of the MEMS chips X3 and X4 is changed. On the other hand, since, in the lower-hole item, the mounting substrate 82 having a high rigidity is present between the gasket 83 and the microphone units 1 and 2, the stress as described above is unlikely to be applied to the MEMS chips 13 and 15.

(Others)

The microphone units 1 and 2 and the sound input device 8 according to the embodiments described above are simply illustrative of the present invention; the scope of the present invention is not limited to the embodiments described above. In other words, various modifications of the embodiments described above may be performed without departing from the spirit of the present invention.

For example, although, in the embodiments described above, the ASICs 14 and 16 (electrical circuit portion) are included in the microphone units 1 and 2, the electrical circuit portion may be arranged outside the microphone unit. Although, in the embodiments described above, the MEMS chips 13 and 15 and the ASICs 14 and 16 are formed into separate chips, the integrated circuits of the ASICs 14 and 16 may be monolithically formed on the silicon substrate of the MEMS chips 13 and 15.

In the embodiments described above, the example where the acoustic sealing portion around the first sound hole 23 and the second sound hole 25 is also used as the electrode pad, and is realized by solder joining is described. In another example of the configuration of the acoustic sealing portion, a thermoplastic adhesive sheet may be adhered to the perimeter of the first sound hole 23 and the second sound hole 25 such that seal joining is performed at the time of solder reflow.

Although, in the embodiments described above, the first vibration portion and the second vibration portion of the present invention are the MEMS chips 13 and 15 formed by utilizing a semiconductor manufacturing technology, the present invention is not intended to be limited to this configuration. For example, the first vibration portion and/or the second vibration portion may be a capacitor microphone using an electret film or the like.

In the embodiments described above, as the first vibration portion and the second vibration portion of the present invention, a so-called capacitor microphone is employed. However, the present invention can also be applied to microphone units employing microphones other than the capacitor microphone. For example, the present invention can also be applied to microphone units employing the microphones of electrodynamic type (dynamic type), electromagnetic type (magnetic type), piezoelectric type and the like.

Figure 25:
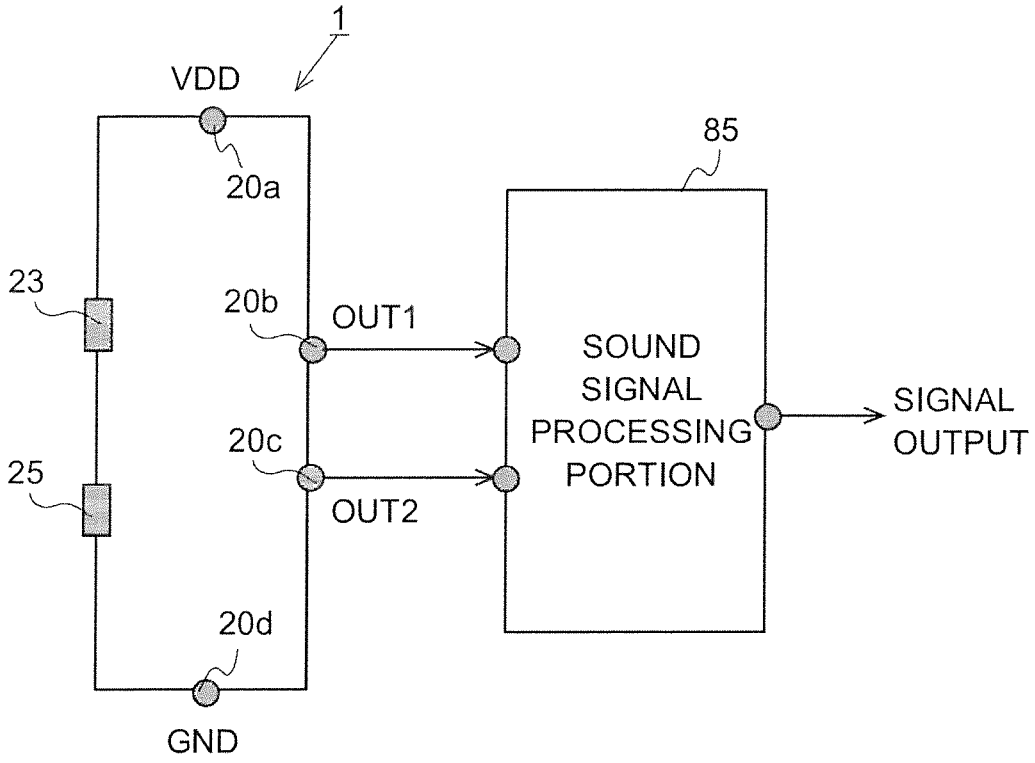
[FIG. 25] A block diagram for illustrating a variation of a sound input device according to the present embodiment.

As a variation of the sound input device (mobile telephone 8) on which the microphone unit 1 described above and according to the present embodiment is mounted, the signal corresponding to the first MEMS chip 13 and the signal corresponding to the second MEMS chip 15 may be subjected to addition, subtraction or filter processing in the sound signal processing portion 85 (see FIG. 25).

This type of processing is performed, and thus it is possible to control the directivity characteristic of the sound input device (for example, a mobile telephone) and receive the sound of a specific area. For example, it is possible to realize an arbitrary directivity characteristic such as an omnidirectivity, a hyper cardioid, a super cardioid or a unidirectivity.

Although, here, the processing for controlling the directivity characteristic is performed by the sound input device, the ASICs of the microphone unit may be formed into one chip, and a processing portion that can perform processing for controlling the directivity characteristic on the ASICs may be provided.

The shape of the microphone unit is not intended to be limited to the shape of the present embodiment; various modifications of the shape are naturally possible.

INDUSTRIAL APPLICABILITY

The microphone unit of the present invention can be suitably used for, for example, mobile telephones.

LIST OF REFERENCE SYMBOLS

1, 2 microphone unit
8 mobile telephone (sound input device)
10, 50 enclosure
11, 51 mounting portion
11*a*, 51*a* mounting surface
11*b*, 51*b* back surface of the mounting surface
12, 52 lid portion
13 first MEMS chip (first vibration portion)
14 first ASIC (first electrical circuit portion)
15 second MEMS chip (second vibration portion)
16 second ASIC (second electrical circuit portion)
18*a* to 18*c*, 19*a* to 19*c* electrode terminal (electrode on the mounting surface)
20 external connection electrode pad (back surface electrode pad)
20*e* sealing electrode pad (sealing portion)
21 first opening portion
22 second opening portion
23, 61 first sound hole
24, 64 hollow space
25, 63 second sound hole
41, 71 first sound path
42, 72 second sound path
45 ASIC (electrical circuit portion)
65 opening portion
82 mounting substrate
121 first holding space
122 second holding space
134 first diaphragm
154 second diaphragm
521 holding space

The invention claimed is:

1. A microphone unit comprising:
a mounting portion in which a first diaphragm, a second diaphragm and an electrical circuit portion are mounted on a same mounting surface; and
a lid portion which covers the first diaphragm, the second diaphragm and the electrical circuit portion,
wherein the first diaphragm and the second diaphragm are arranged substantially parallel to the mounting surface,
in a back surface of the mounting surface of the mounting portion, a first sound hole and a second sound hole are provided, and
an enclosure formed with the mounting portion and the lid portion includes:
a first sound path that transmits sound waves input through the first sound hole to one surface of the first diaphragm and also transmits the sound waves to one surface of the second diaphragm;
a second sound path that transmits sound waves input through the second sound hole to the other surface of the second diaphragm; and
an airtight space facing the other surface of the first diaphragm.

2. The microphone unit of claim 1, wherein:
the lid portion forms, together with the mounting portion, a first holding space holding the first diaphragm and a second holding space holding the second diaphragm,
in the mounting surface, a first opening portion that is covered by the first diaphragm and a second opening portion that is covered by the second diaphragm are provided,
the first sound path is formed with the first sound hole, the first opening portion, the second opening portion and a hollow space that is formed within the mounting portion and that makes the first sound hole communicate with the first opening portion and the second opening portion,
the second sound path is formed with the second sound hole and the second holding space, and
the first holding space is the airtight space.

3. The microphone unit of claim 1, wherein:
the lid portion forms, together with the mounting portion, a holding space holding the first diaphragm and the second diaphragm;
in the mounting surface, an opening portion that is covered by the second diaphragm is provided;
the first sound path is formed with the first sound hole and the holding space; and
the second sound path is formed with the second sound hole, the opening portion and a hollow space that is formed within the mounting portion and that makes the second sound hole communicate with the opening portion.

4. The microphone unit of claim 1, wherein the electrical circuit portion comprises:
a first electrical circuit portion that processes the electrical signal obtained in the first diaphragm; and
a second electrical circuit portion that processes the electrical signal obtained in the second diaphragm.

5. The microphone unit of claim 1, further comprising:
an electrode formed on the mounting surface for electrical connection to the electrical circuit portion; and
an electrode pad formed on a back surface of the mounting portion and electrically connected to the electrode.

6. The microphone unit of claim 1, further comprising a sealing portion formed on the back surface of the mounting surface of the mounting portion so as to produce airtightness when the sealing portion is mounted on a mounting substrate to surround perimeters of the first sound hole and the second sound hole.

7. A sound input device comprising the microphone unit of claim 1.

* * * * *